US005320377A

United States Patent [19]

Ruffinengo

[11] Patent Number: 5,320,377

[45] Date of Patent: Jun. 14, 1994

[54] APPARATUS FOR SELECTIVITY VARYING THE STIFFNESS OF A SKI

[76] Inventor: Piero Ruffinengo, 820 Edgehill Rd., Salt Lake City, Utah 84103

[21] Appl. No.: 114,385

[22] Filed: Aug. 30, 1993

Related U.S. Application Data

[60] Division of Ser. No. 828,140, Jan. 30, 1992, Pat. No. 5,280,942, which is a continuation-in-part of Ser. No. 715,598, Jun. 14, 1991, Pat. No. 5,251,923.

[51] Int. Cl.[5] ..... A63C 9/08

[52] U.S. Cl. ..... 280/602; 280/634

[58] Field of Search ..... 280/601, 602, 617, 611, 280/623, 625, 633, 634

[56] References Cited

U.S. PATENT DOCUMENTS

| | | | |
|---|---|---|---|
| 2,258,046 | 10/1941 | Clement | 280/11.13 |
| 3,260,531 | 7/1966 | Heuvel | 280/11.13 |
| 3,260,532 | 7/1966 | Heuvel | 280/11.13 |
| 3,398,968 | 8/1968 | Mutzhas | 280/602 |
| 3,531,135 | 9/1970 | Salomon | 280/11.35 |
| 3,937,481 | 2/1976 | Koleda | 280/11.35 |
| 4,221,400 | 9/1980 | Powers | 280/602 |
| 4,294,460 | 10/1981 | Kirsch | 280/617 X |
| 4,444,413 | 4/1984 | Richert et al. | 280/632 |
| 4,577,886 | 3/1986 | Chernega | 280/602 |
| 4,896,895 | 1/1990 | Bettosini | 280/618 X |
| 4,903,979 | 2/1990 | Dimier | 280/628 |
| 4,974,867 | 12/1990 | Rullier et al. | 280/607 |
| 5,135,250 | 8/1992 | Abondance et al. | 280/617 |
| 5,150,914 | 9/1992 | Gorza | 280/616 |

FOREIGN PATENT DOCUMENTS

| | | | |
|---|---|---|---|
| 373786 | 2/1984 | Austria | A63C 9/00 |
| 0104185 | 3/1983 | European Pat. Off. | A63C 9/00 |
| 0409749 | 7/1990 | European Pat. Off. | A63C 9/00 |
| 0424846A1 | 5/1991 | European Pat. Off. | A63C 9/00 |
| 0460574A1 | 12/1991 | European Pat. Off. | A63C 5/07 |
| 1603002 | 8/1971 | Fed. Rep. of Germany | A63C 5/06 |
| 2135450 | 7/1974 | Fed. Rep. of Germany | A63C 9/00 |
| 2833393 | 2/1980 | Fed. Rep. of Germany | 280/602 |
| 3204689 | 8/1983 | Fed. Rep. of Germany | A63C 5/07 |
| 1269049 | 6/1961 | France . | |
| 1407710 | 6/1964 | France | A63C 5/07 |
| 2433350 | 3/1980 | France | A63C 5/07 |
| 2654635 | 11/1989 | France | A63B 9/082 |
| WO/88/053-24 | 7/1988 | PCT Int'l Appl. | A63C 5/07 |

*Primary Examiner*—Margaret A. Focarino
*Assistant Examiner*—Michael Y. Mar
*Attorney, Agent, or Firm*—D. Peter Hochberg; Mark Kusner; Michael Jaffe

[57] ABSTRACT

A system for changing the stiffness of a ski includes springs for urging a ski boot into a ski binding, and apparatus for modifying the biasing force to change the stiffness of the ski.

6 Claims, 28 Drawing Sheets

APPARATUS FOR SELECTIVITY VARYING THE STIFFNESS OF A SKI

BACKGROUND OF THE INVENTION

1. Field of the Invention

This is a division of Ser. No. 07/828,140, filed Jan. 30, 1992, now U.S. Pat. No. 5,280,942 which is a continuation-in-part application based on U.S. patent application Ser. No. 715,598, filed Jun. 14, 1991 now U.S. Pat. No. 5,251,923 for "Support Plate for a Safety Ski Binding" by Premek Stepanek, Ludwig Wagner, Edwin Lehner and Piero G. Ruffinengo.

This invention relates to ski control apparatus for varying the characteristics of a ski according to the nature of the snow being skied upon, the type of skiing being performed, the nature of the ski and the skill of the skier, to improve the quality of the skiing and safety of the skier. It relates in particular to apparatus which vary the stiffness of the ski according to the foregoing conditions.

2. Description of Background and Relevant Information

Important conditions affecting downhill skiers are the nature of the snow, the type of skiing to be done, the type of skis and bindings used and the skill of the skier. The snow and the ski run can vary during a day, while the ski and the skier are generally invariable. The snow can range from ice hard snow, to very loose or soft snow, sometimes called powder snow. There are profound differences in skiing turns and speed according to the type of snow being skied upon. One primary characteristic of a ski is its ability to bend or flex longitudinally, with its forward and rearward portions moving above the center part of the ski, as it carries a skier. A ski flexes and counterflexes, and keeps the skier in control as he or she follows the contour of a slope and enables a skier to manipulate the skis as he or she bounds and rebounds down the slope. In racing events, the snow can be ice hard both to increase the skier's speed and to avoid ruts in the snow. Hard snow may limit the bending of the skis. Turning is mainly accomplished in hard snow by the skier tilting the skis to dig the edges at the bottom of the ski into the snow by shifting his or her weight and body position. On the other hand, the ski can bend in a large amount in powder snow. The longitudinal sides of skis are convex arcs, and it is through the use of the side cuts and bending of the ski that the skier turns; the edges of the skis are of much less importance in turning in powder snow. Regular snow, that is snow whose texture and packing is between hard snow and powder snow, presents other problems to the skier. Experience, communications with racers and other skiing experts, and testing, indicate that a ski stiffer underfoot of the ski boot may be preferable in very hard snow conditions while an overall more flexible ski appears to be preferable in soft snow conditions. An intermediate situation is preferable for snow of intermediate softness. It is also known that a ski loosely attached to the skier transfers little energy from the ski to the skier when the ski encounters obstacles, thus resulting in higher speed. However, a loose attachment results in loss of ski control in turns; hence it is desirable to have a loosely connected ski when traveling essentially in a straight line for greater speed and a tightly connected ski when making turns for greater control.

The vibration characteristics of skis are also believed to be important. Skis have several vibration modes which are exhibited during skiing. High frequency vibrations break the contact between the ski bearing surface and the snow, which improves speed. On very hard snow conditions, the breaking of the contact between running surface and snow does not result in the same level of benefit but the ski still vibrates resulting in audible and perceptible chatter. A reduction in chatter is desirable in these conditions. Thus different requirements in underfoot stiffness and vibration exist depending on snow conditions. The ski designer, faced with the different kinds of snow, the different types of skiing, and variations in skiers and their bindings, can only develop skis which can handle all of these varying characteristics reasonably well but are not optimized for any specific condition.

All ski bindings have an effect on ski stiffness underfoot. When a ski bends during skiing, the distance between the toe piece and the heel piece varies since they move relative to each other with the upward curvature of the ski. However, the length of the ski boot sole remains constant. Therefore, there is generally a limited movement rearwardly of the heel piece in a clamp on the ski to keep it in contact with the boot. The force required to move the heel unit back results in a stiffening of the ski section directly under the binding and boot. It is believed that most ski bindings on the market fall into this category. Therefore ski manufacturers take this stiffening action of the binding system into consideration in the design of the ski. The underfoot stiffness of the ski/binding combination is thus optimized for the type of skier and preferred snow conditions for which the ski was intended. Different binding systems and separate devices to be used in conjunction with the ski and commercially available bindings have been manufactured to either increase or decrease the underfoot stiffness of the basic binding/ski configuration. Other devices can effect the normal vibration of a ski. Combinations which decrease stiffness underfoot may improve soft snow skiability while deteriorating skiability towards the end of the hard snow spectrum. Combinations which increase stiffness have the opposite effect.

In some systems, the binding is constructed to render the ski more flexible. In the ESS v.a.r. device, a boot support plate having a forward portion which is slidable in a channel on the ski, should render the ski more flexible. However, the support plate is fixed with additional fastening means to the ski, and thus is believed to limit its benefit on soft snow. The fixing of the support plate decreases the bending of the ski.

The Tyrolia Freeflex system utilizes a flexible plate attahed to the top of the ski. The plate is fixed to the ski at the toe of the binding and is held in place about the heel by a slidable clamp fixed on the ski. Both toe and heel binding units are affixed on the boot support plate. When the ski bends, the heel clamp moves closer to the toe unit but the flexible plate is allowed to slide rearwardly reducing the tendency of the heel unit to move towards the toe unit as in a normal binding configuration. The ski is thus allowed to flex more underfoot. The plate is allowed to move in the slidable clamp but is also held to the ski by an additional sliding point between the toe and the heel. This mounting configuration increases sliding friction and thus the overall decrease of ski stiffening is relatively small. Devices of this nature are disclosed in U.S. Pat. No. 3,937,481.

Most ski binding manufacturers produce bindings which increase the stiffness of skis. The stiffness of a ski provides a firm edge to drive into the snow for making turns in hard or intermediate snow. In this respect, it is much like an ice skater who drives his or her blade into the ice to make a turn. A flexible blade would detract from the skater making a turn, just as a very soft ski in the section directly below the boot would detract from the skier turning in hard snow.

Some expert skiers performing giant slalom or super giant slalom have found that their turning ability is enhanced when they attach to the ski, such as by gluing, a thin plate on top of the ski in the binding area. This added plate increases the distance between the skier's boot and the edges of the ski, and enhances the leverage which the skier has to drive the edges of the ski into the snow. WIPO Document 83/00039 discloses a device wherein glue and an elastomeric material hold a plate for supporting a toe piece and heel piece to the ski. The elastomeric material absorbs some of the vibration of the ski on the hard snow and relieves some of the discomforting noise of the ski rapidly smacking against the snow. Furthermore, the device stiffens the ski/plate/-binding combination in the underfoot area of the ski improving edge control on hard snow. In another device called the Rossi-Bar and disclosed in European Patent Office Publication No. 0409749, a support bar on the ski has stops of elastomeric material at its forward and rearward ends. However, the bar is locked to the ski by clamps along the length of the bar, and it is the clamps and not the rubber stops which prevent the bar from sliding on the ski. Thus, the plate reduces the bending of the ski. In U.S. Pat. No. 3,937,481 (mentioned earlier) a ski binding having an elongated plate is slidably mounted thereon for cushioning the skier when a forward abutment is encountered. Only the forward or toe portion of the system is fixed to the ski, so that the plate allegedly follows the bending of the ski. The device in fact impedes the bending of the ski since it is strapped to the ski in a number of places. A similar device with similar shortcomings is disclosed in Austrian Patent 373,786. A device of this type is sold under the name Derbyflex. It has been believed by many experts that raising the ski binding with such a plate detracts from the skier's ability to control the ski, since it was thought that the skier had to be close to the snow to "feel" the snow and ski accordingly. The present inventors and other manufacturers believe that this notion is wrong for most types of skiers, and that holding a ski boot somewhat high over the ski increases his or her ability to control the ski. Other patents disclosing ski bindings for increasing stiffness in skis include German Patent 2,135,450 and European Publication 0409749A1.

Even though the added plate is beneficial, it only applies to skiing on hard snow where a stiffer underfoot ski is desirable. When used on softer or powder snow, the added stiffness detracts from the skier's ability to control the ski since easier bending adds to the turnability of the ski in soft snow.

Other devices are known having movable boot support plates on skis. For example, U.S. Pat. No. 4,974,867 discloses a shock absorbing buffer disposed between a ski and a binding, and is not really related to the stiffness of the binding.

The skill of the skier is another condition which the skiing apparatus should take into consideration. Although stiff skis are beneficial to good skiers in events such as giant slalom and super giant slalom, novice skiers should generally use flexible skis for all events, since they enable reasonable performance even though edge control in turns may be sacrificed. The inventor is unaware of any ski bindings or skis which are adaptable to vary the stiffness in the binding location of a ski system according to the nature of the snow or the type of skiing being done. He is aware of no skiing system whose stiffness and vibration characteristics can be changed to perform well in the various skiing conditions.

BRIEF DESCRIPTION OF THE INVENTION

It is an object of the invention to provide an improved device for controlling snow skis according to the nature of the snow, the skiing to be done, the type of skis and/or the skill of the skier.

Another aspect of the invention is to provide a system for a ski binding having a biasing means for urging a ski boot longitudinally to cause the binding to attach a ski boot to the ski, and means for controlling the biasing means to control the stiffness of a ski.

Another object is to provide spring means for biasing a ski boot longitudinally on a ski and means for adjusting the spring means to vary the stiffness of the ski.

Yet still a further object is to provide a ski boot sole having at least two portions mountable in a ski binding, the sole having biasing means operatively connecting the portions for operatively connecting the sole to the binding and for imparting stiffness to the ski as the ski bends.

Another object is to provide a ski boot sole having sections relatively movable in a longitudinal direction when the sole is mounted on a ski, and biasing means for urging the sole longitudinally into the toe piece and into the heel piece of a ski binding, the biasing means also adding stiffness to the ski against longitudinal bending.

Yet a further object is to provide a ski boot sole of the foregoing type, and means for varying the biasing force to vary the stiffness of the ski.

It is a general object of the present invention to provide improved ski control systems for use with various types of snow, different degrees of skill of the skier and different skiing events, which systems are efficient to manufacture and to use.

The invention comprises systems for controlling the stiffness of a ski to the longitudinal bending of the ski. The systems include a series of members which are movable relative to each other and fixed to the ski at the opposite ends of the series. Biasing means operatively connect these members. The force of the biasing means on the members can be changed to change the stiffness of the series of members and of the ski beneath the series.

In one embodiment, the system includes a heel piece having a forward pressure spring for urging a ski boot forwardly towards the toe piece fixed on the ski, and other biasing means which can selectively apply their bearing force on the boot to vary the stiffness between the heel piece and the toe piece, and on the underlying ski. Many varieties of biasing means, such as coil springs. leaf springs, resilient material, hydraulic means and the like, can be used. The ways of activating the biasing means are also wide in number, and could include movable abutting surfaces, linear or rotating spring activating and deactivating means, and the like.

In another embodiment, the boot sole has separate portions which are longitudinally movable when received in a ski binding, and biasing means operatively connecting the portions for urging the sole into the ski binding which now can have fixed toe and heel pieces. The biasing means controls the stiffness of the boot sole and of the ski, and the biasing force can be varied to change the stiffness. The biasing means can include two or more springs which can selectively be activated to exert their biasing force and increase the stiffness, or be deactivated to reduce the stiffness.

In still another embodiment, biasing means are applied at the toe or the heel of the boot for holding the ski boot between the toe and heel pieces. These biasing means contribute to the stiffening of the ski, and can be varied by varying the biasing force.

Other objects will occur to those skilled in the art and to which the appended claims pertain.

BRIEF DESCRIPTION OF THE DRAWINGS

The invention will be better understood when reference is had to the following drawings in which like numbers refer to like parts, and in which.

DETAILED DESCRIPTION OF THE PREFERRED EMBODIMENT OF THE INVENTION

Figure 1:
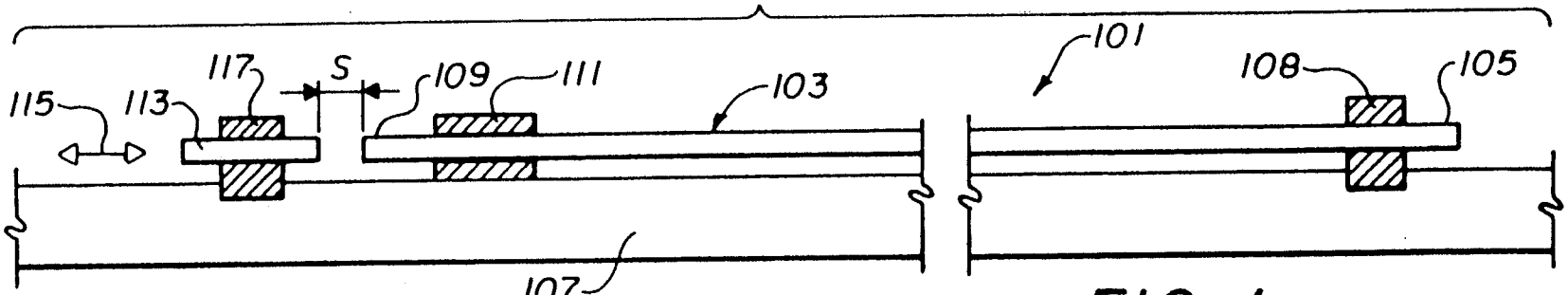
FIG. 1 is a schematic drawing showing an engagement means as a support plate, and an impedance means as an adjustable stop.
Figure 4:
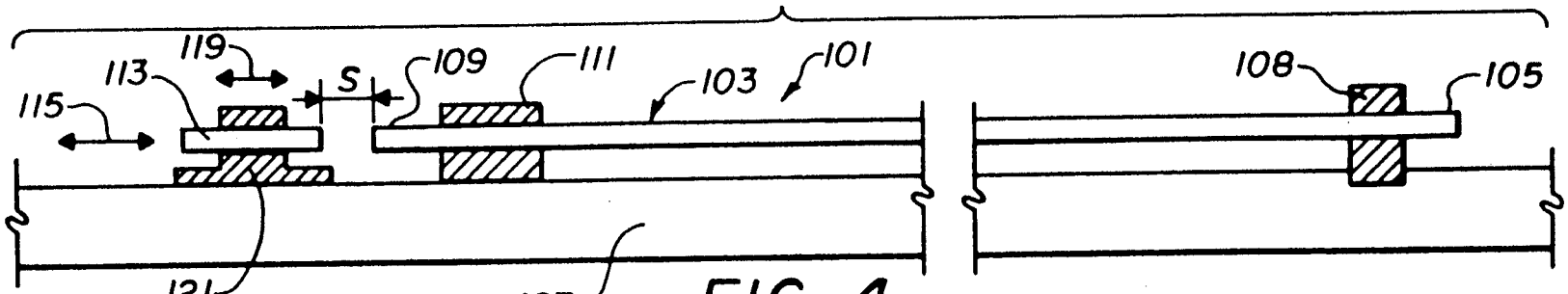
FIG. 4 is a schematic drawing of the apparatus of FIG. 1, but with an adjustable clamp.

A stiffness controlling assembly 101 is shown in FIG. 1. The assembly includes an engagement means which can be a support plate 103, one of whose ends 105 is fixed to the ski 107 as indicated by fastening member 108 and its second end 109 is a free end which can slide in a longitudinal direction of ski 107 within guide means such as a support clamp 111. For the sake of this discussion, end 109 is closest to the forward end of the ski. An impedance means, shown here as an adjustable member, control member or stop 113, can be moved forwards or rearwards to preselected positions as indicated by the arrow 115 within its holding member or clamp 117. As shown, adjustable stop 113 can be moved relative to plate 103 and ski 107, within clamp 117 as indicated by arrow 115. Referring to FIG. 4, a movable clamp 121 can be moved as well with stop 113 held therein for preliminary adjustments, such as by a store or ski shop, to set the stiffness controlling assembly for the type of ski and skill of the skier, as indicated by arrow 119. A space of variable distance between stop 113 and end 109 is designated by the letter S.

Figure 2:
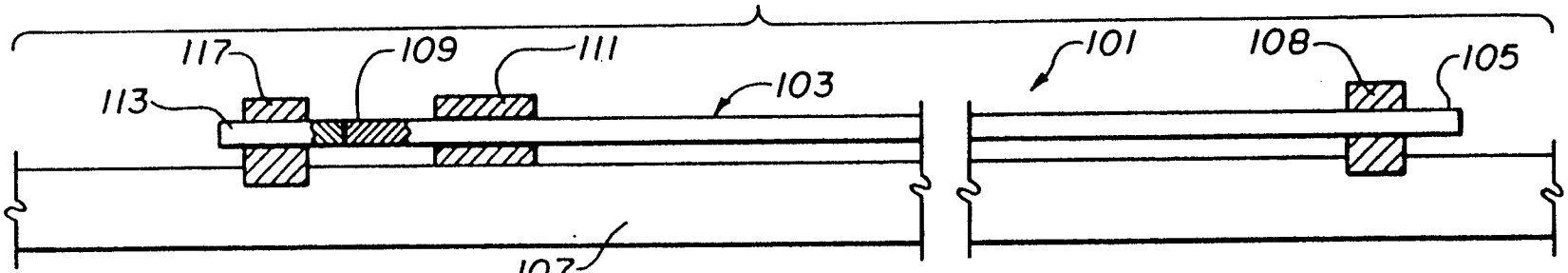
FIGS. 2 and 3 show two settings of the apparatus shown in FIG. 1.
Figure 3:
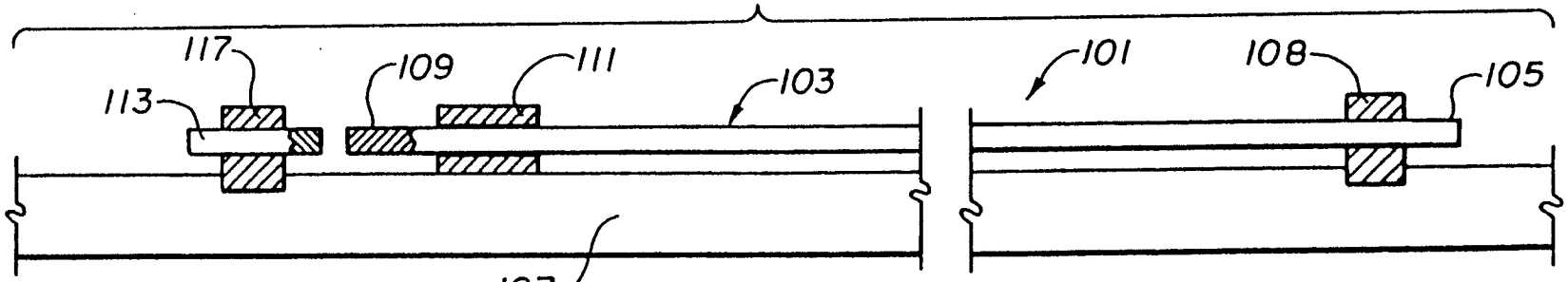

When assembly 101 is to reduce the bending of the ski, as for example when the ski is to be turned in hard snow, adjustable stop 113 is moved to engage free end 109 of support plate 103, so that S equals 0, as shown in FIG. 2. This renders plate 103 substantially unable to move as bending movements are applied to the ski, and makes the ski stiff beneath plate 103. When the ski is to have its bending unimpaired, stop 113 is moved away from plate 103 as shown in FIG. 1, with S having a relatively high value. Then, regardless of the bending of the ski 107, plate 103 cannot engage stop 113, and no additional stiffness is added to the ski. For an intermediate stiffening condition, as where the skier is making turns on regular snow, S is set to a moderate value as shown in FIG. 3, so that free end 109 only contacts stop 113 during turns when the ski bends sufficiently for the contact to occur, to avoid further bending and improve edge control. The assembly could be arranged so that stop 113 is only set for intermediate stiffness control as shown in FIG. 3, in which holder 117 would not allow the adjustment of stop 113.

It should be noted at this time that the foregoing and many of the drawings to follow are schematic in nature, and that S need not be a complete space but could have some substance therein; however, the stiffening feature of the invention will nonetheless apply. Also, the support plate 103 has been shown as an integral member, but it could include a number of members whose effect is as shown for stiffening the ski. Likewise, the adjustable member or stop can have different forms, some of which are shown below.

Figure 5:
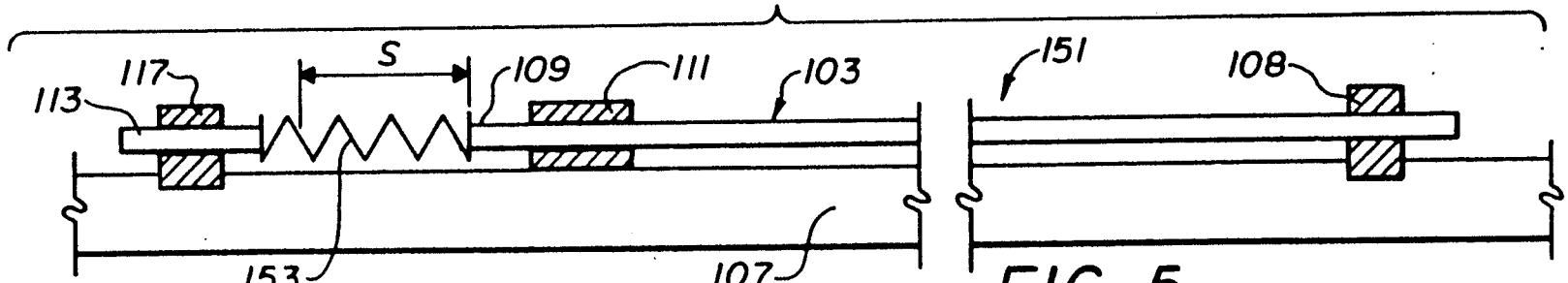
FIG. 5 is a schematic drawing showing where the impedance means includes a progressively variable member as the ski flexes and counterflexes.

Another form is illustrated schematically in FIG. 5, showing an embodiment where a substance is included in space S. As in the previous Figures, the assembly 151 of FIG. 5 includes a plate 103 held fast at one end to ski 107 by an attachment 108, and its free end 109 is supported for sliding movement in support clamp 111. An adjustable stop 113 is held by a clamp 117. A biasing means such as a coil spring 153 is connected between the end of free end 109 and the end of stop 113 facing it. As free end 109 moves towards stop 113 when ski 107 bends, spring 153 compresses. As spring 153 compresses more with increased bending, the spring forces get progressively greater, resisting the sliding of free end 109. This impedes further bending of the ski. As ski 107 continues to bend, the spring eventually becomes totally compressed, S declines to 0 (S being the distance between the end of free end 109 and the end of the totally compressed spring 153). At this point, assembly 151 is set for turning in hard snow, and plate 103 is unable to slide towards stop 113 and the ski beneath plate 103 is stiff. The counterflexing movement of ski 107 is easier as the ski continues to unbend, since the tension on spring 153 gets progressively less. When the ski is unloaded in this configuration, spring 153 releases its energy against stop 113 and free end 109 of plate 103, causing the ski to counterflex with progressively greater energy and speed. This, in turn, allows the skier to unweigh during counterflex, so that the skiing apparatus rather than the skier absorbs much of the shock as the skier goes down a slope.

Figure 6:
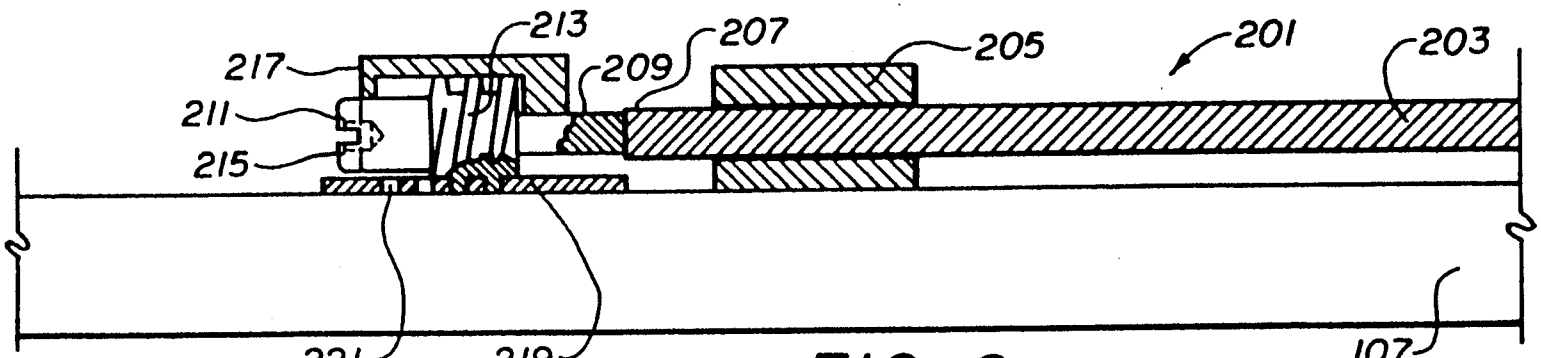
FIG. 6 is a schematic drawing of a stiffness system having a screw adjustable stop.

A schematic of another embodiment 201 is shown in FIG. 6. Here, a support plate 203 is mounted above a ski 107, with one end, here its rearward end (not shown), fixed to the ski, and its opposite end which is free, clamped for sliding engagement over the ski by clamps or guides 205. Free end 207 is mounted for engagement with a control member or an adjustable stop 209 which is urged forwardly or backwardly by a screw 211 having threads 213 and a head 215. Screw 211 is mounted in a housing 217. A base plate 219 having thread receiving slots 221 is mounted beneath housing 207 on ski 107. With adjustable stop 209 in engagement with free end 207 of the support plate, the support plate 203 is in a stiff configuration, and cannot bend with the ski but rather restricts the ski from bending beneath assembly 201. In this implementation, the space S between free end 207 and adjustable stop 209 can be adjusted simply by turning screw 211. With S=0 the ski is relatively stiff underneath assembly 201. If S is very large, assembly 201 has essentially no impact on the stiffness of the ski under the assembly. The skier can also adjust S for different relatively small values to stiffen the ski more or less during turns.

Figure 7:
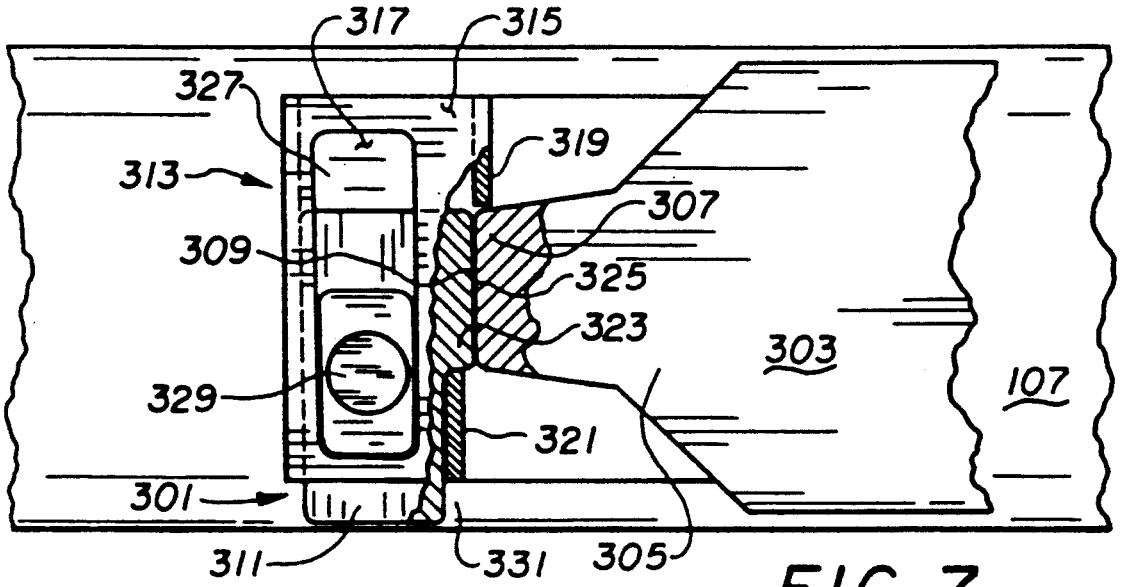
FIG. 7 is a schematic drawing of another form of the stiffness system for a ski where the adjustable stop is a transversely movable member.

FIG. 7 shows a transversely movable assembly 301 as part of another embodiment. Here, a partial top view of the ski 107 includes a support plate 303 which is fixed to the ski at one end, here the rear end, and which is free at its other end 305. End 305 has a narrow portion 307 which ends in a forwardly facing abutment 309. Transversely movable assembly 301 comprises a transversely movable control member 311, a housing 313 including a top wall 315, a base 317, walls 319, 321, and an aperture 327. Member 311 is mounted for movement transverse to ski 107, and has a rearwardly facing protuberance 323 with a rearward abutment face 325 and a peg or handle 329 attached to slide 311 which extends through aperture 327. Surfaces are provided defining a recess 331 which extends partly transverse to the ski and is adjacent protuberance 323. Member 311 can be moved across the ski by sliding peg 329 along aperture 327. Top wall 315 retains member 311 in place. Support walls 321 and 319 extending transverse to the ski are provided for maintaining member 311 in place when member 311 is in either of its positions, i.e., on the upper part of FIG. 7 when recess 331 faces abutment 309, or when (as shown) abutment 325 opposes abutment 309.

When the ski is to be placed in its extremely stiff mode, such as when the skier is going to perform giant slalom or superior giant slalom events in hard snow, the skier moves slide 311 so that the slide abutment face 325 engages abutment 309 as shown in FIG. 7. As the ski attempts to bend or flex, support plate 303 is held fast by member 311, giving the ski its stiff underfoot quality, giving the skier more control during his turns on the ski run. On the other hand, when the ski is to be used in softer snow, slide 311 is moved upward so that recess 331 faces abutment surface 309. In this setting plate 203 is free to move forward when the ski flexes and the ski is not stiffened. This embodiment, shown with two positions could be implemented with additional positions and intermediate recesses for obtaining intermediate stiffening conditions.

Figure 8:
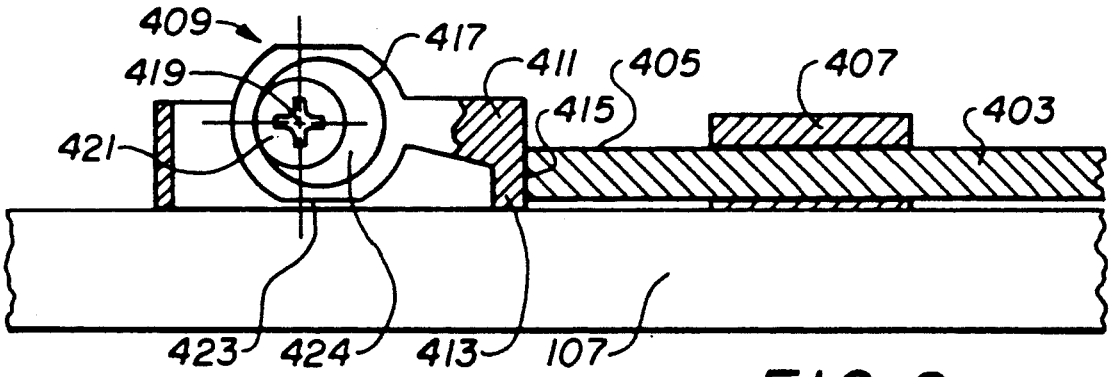
FIG. 8 is a schematic drawing of still another form of the stiffness system where the adjustable stop includes an eccentric rotatable on a horizontal axis transverse to the ski.

Still another embodiment is shown in FIG. 8. Here, a support plate 403 is fixed at one end, shown here as its rear end towards the back of ski 107, and has a front end 405. A clamp or guide 407 holds plate 403 for sliding engagement relative to ski 107. A retaining member 409 has a rearwardly extending control arm 411 having a downwardly extending foot 413 whose rearwardly facing face 415 is an abutment or contact 415. The retaining member 409 includes a horizontal cylinder 417 having its axis perpendicular to the axis of the ski. An axis of rotation 419 is offset from the natural rotational axis. Cylinder 417 is rotatable about an axis 419 forward of the center of rotation of the foregoing cylinder by means of a tool such as a screw driver inserted into the head 421 of the eccentric. Rotation of head 421 counterclockwise rotates eccentric 424 counterclockwise, moving the arm 411 forwardly and away from the supporting plate 403. Sufficient movement of arm 411 provides a space between abutment 415 and the free end 405 of support plate 403, providing a space between the two members so that support plate 403 allows limited bending of ski 107. The further forward arm 411 is from support plate 403, the more bending is possible.

Figure 9:
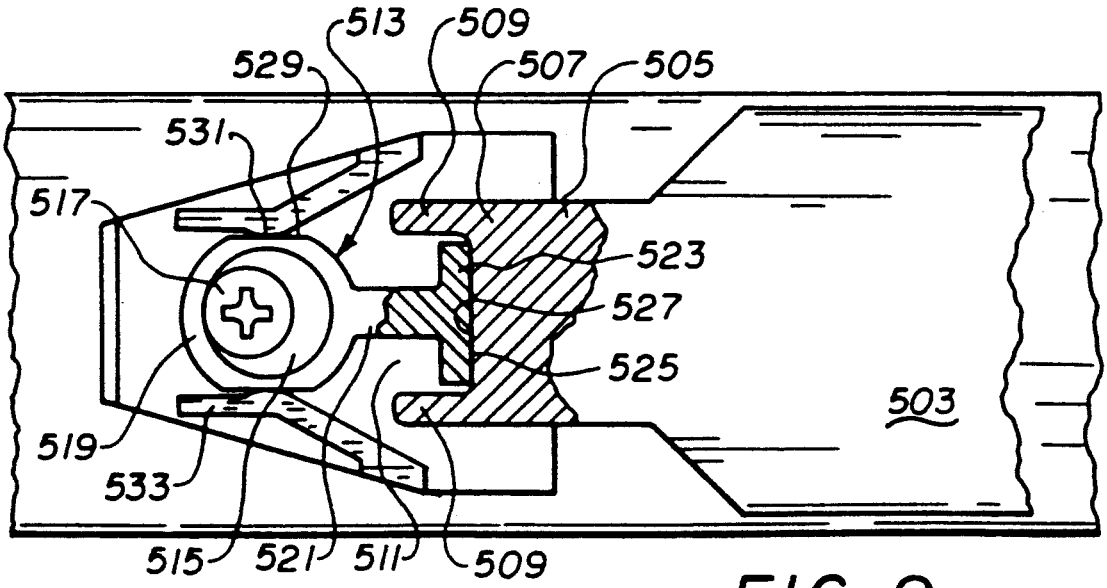
FIG. 9 is a schematic drawing of a form of a stiffness system where the adjustable stop includes an eccentric rotatable about an axis vertical to the ski.

Referring next to FIG. 9, the device somewhat similar to that shown in FIG. 8 is illustrated. Here, a support plate 503 includes one end which is fixed to the ski (not shown), which here is the rear end of the support plate, and a forward end 505 which is tapered towards its longitudinal axis to form a forwardly extending leg 507 from which two legs 509 extend on opposite sides of a centrally located recess 511. Forwardly of the support plate is disposed an eccentric adjustment or control member 513 having a cylindrical member 515 and with a turning head 517. Eccentric 513 rotates about the central axis of cylinder 515 as head 517 is rotated. Adjustment member or stop 513 includes a follower 519 defining a cylindrical bore in which cylindrical member 515 is concentrically located, and a rearwardly extending leg 521, terminating in a transverse leg 523 having a rearwardly extending abutment face 525. The latter abutment face faces abutment face 527 of support plate 503. The follower has flat surfaces 529 on opposite sides thereof for engagement with opposite, external surfaces 531 of spring 533 extending from a base plate.

The stiffness of the apparatus shown in FIG. 9 depends upon the location of adjustment face 525 and the abutment face 527 of support plate 503. In its rearward position, the adjustment member engages face 527 of support plate 503, so that the support plate cannot move relative to the ski, to render the ski stiff. If the eccentric is turned counterclockwise, the follower moves forwardly and creates a space with forward part 509 of the support plate 503. If the space is sufficient so that no amount of bending will cause surface 525 to engage the support plate 503, considerable bending of the ski is possible, and would be particularly useful in powder snow. On the other hand, where the ski is to become stiff only in conditions of hard curves, the eccentric is moved to create a space between abutment surfaces 525 and 527. When there is not sufficient bending of the ski, as in straight skiing down a slope, the support plate allows the ski to bend. However, if there are hard turns made, the rearwardly facing abutment surface 529 engages the forwardly facing abutment surface 527, rendering the ski stiff and inflexible. The rotation of the eccentric thus determines the spacing between the two abutment surfaces and the relative stiffness of the ski.

Figure 10:
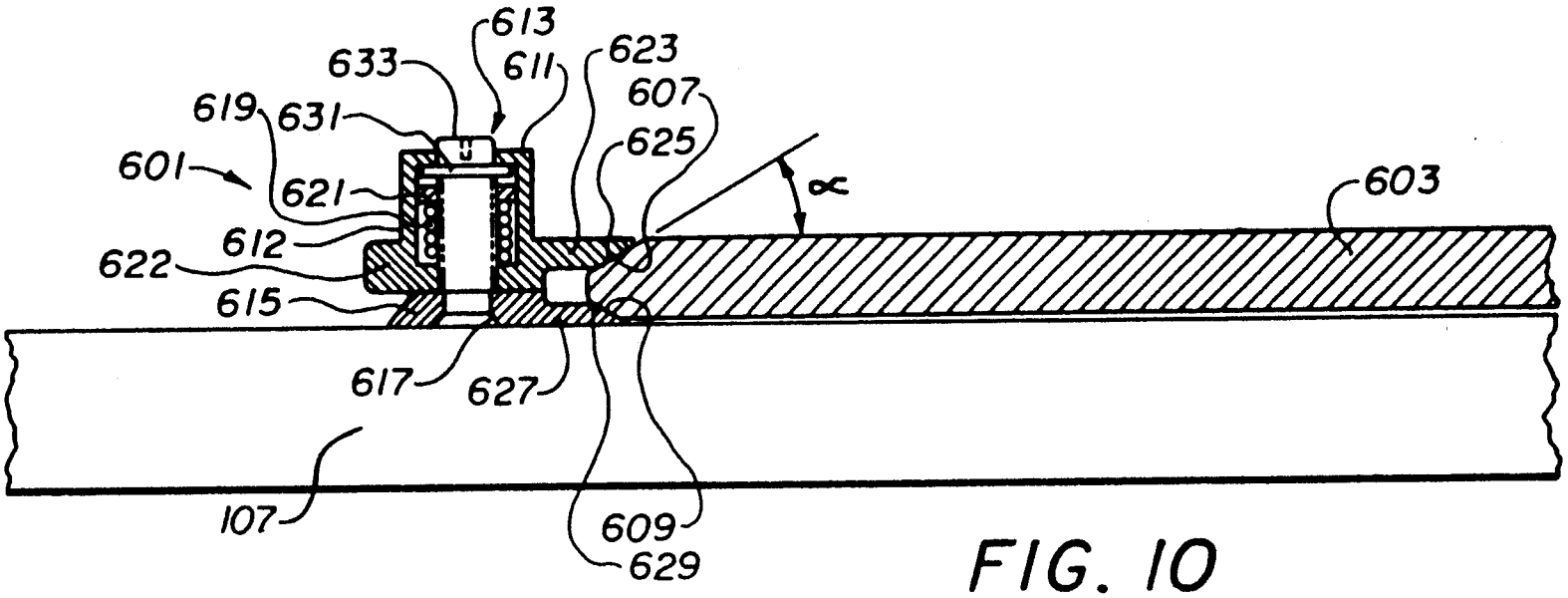
FIG. 10 is a schematic drawing of a form of a stiffness system where the impedance means is a continuously variable bias device including a friction member.

Referring next to FIG. 10, a stiffness controlling assembly 601 is shown including a support plate 603 which is fixed to the ski 107 at one end, here the rear end of the plate, and is free at its opposite end, which shown here is the forward end 605. The free end has tapered portions at the upper and lower part of plate 603 with inclined faces shown at 607 and 609, which run transverse to ski 107. An adjustment, control or retainer member 611 has a housing 612 which is attached to the ski by means of a fastener such as screw 613 and a holding member 615, which is attached to the ski, for receiving retainer or fastening member 613 through a bore 617 contoured to receive the fastener. A spring such as helical spring 619 is disposed in housing 612 and is located to be compressed by compression member such as nut 621 as fastener 613 is rotated. Spring 619 is compressible between shoulder 622 in housing 612 and member 621.

Retainer member 611 includes a flange 623 which extends rearwardly, and has an inclined abutment face 625 which is contoured to engage the face 607 of plate 603. Holding member 615 also has a flange 627 extending partly along the length of ski 107, and having an inclined portion with a face 629 contoured to engage the face 609 of plate 603.

Screw 613 has a flange 631 which is seated beneath the upper end wall of housing 612 of adjustment member 611, and has a head 633 which can be turned to either move nut 621 into holding member 615 to compress spring 619, or to be urged in the opposite direction to relieve the compression on spring 619.

The stiffening in the apparatus shown in FIG. 10 is accomplished by friction rather than by spacing between an adjusting member and a support plate. The apparatus is continuously adjustable.

Therefore, in the operation of assembly 601 in FIG. 10, if further stiffening of the ski is desired, screw 613 is tightened to move nut 621 towards the ski to compress spring 619. This compression urges adjusting member 611, and the face of leg 623 against face 625 of plate 603. The tension created by face 607 and face 625, and face 609 and face 629, essentially clamps plate 603 to the ski at its forward end 605, to substantially prevent bending of ski 107 between fastener 611 and the anchor between the support plate and the ski. In its most compressed condition, the ski apparatus is extremely stiff underfoot, and is particularly useful in curves made on hard snow. As fastener 613 is loosened, the compression on spring 619 decreases, and the tension on end 605 of support plate 603 becomes less and less. In its least compressed condition, the portion of ski 107 under support plate 603 is essentially bendable, and is particularly useful for skiing on loose or powder snow. There is no need for a clamp to guide support plate 603 along ski 107 as the ski bends, since the forward end of the plate is confined between the retainer 611 and the holding member 615. The friction device 601 has some useful features. First, the spring is a progressive force, the spring force increasing as the support plate between the retainer 611 and the holding member 615, increasing stiffness as the ski bends. Second, the spring provides greater friction for flexing than for counterflexing. However, the friction approaches 0 as the angle $\propto$ approaches 0.

Figure 11:
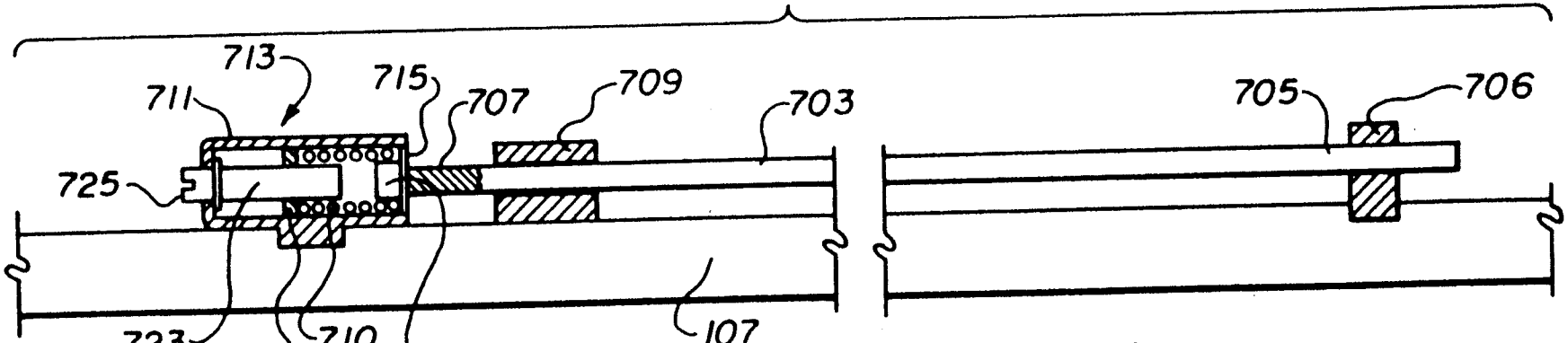
FIG. 11 is a schematic drawing of a form of a ski stiffness system where the impedance means is a continuously variable device.

Another continuously adjustable stiffening system is shown in FIG. 11. Here, a support plate 703 is attached to the ski 107 at one end, here the rear end 705, by a clamp or anchor 706, and is slidable at its other end, here the front end 707, in a clamp 709 through which the forward end can slide as the ski bends. A spring 710 is disposed in a housing 711 of a retainer 713. Housing 711, is fixed to ski 107. The housing has a rearward face 715 having a bore through which forward part 707 of plate 703 extends. An enlarged portion 719 urges end 707, and is larger than the bore in face 715 to preclude it from being removed from housing 711. Spring 710 rests against portion 719 and extends forwardly to a shoulder 721 through which a control fastener 723 extends. Fastener 723 extends through housing 711 along a longitudinal axis above ski 107, opposite plate 703.

In order to change the stiffness of the skiing apparatus shown in FIG. 11, fastener 723 can be moved to change the compression of spring 710, such as by turning its screw head 725 with a screwdriver. At its extreme stiffness, fastener 723 is moved to completely compress spring 710. As the fastener is turned to release spring 710, the stiffness of the skiing apparatus beneath plate 703 decreases. Thus, the harder the snow and the more turns being made, the fastener 723 is adjusted to compress spring 710. As the snow gets softer, spring 710 should be decompressed to enable the control of the ski as discussed earlier.

Figure 12:
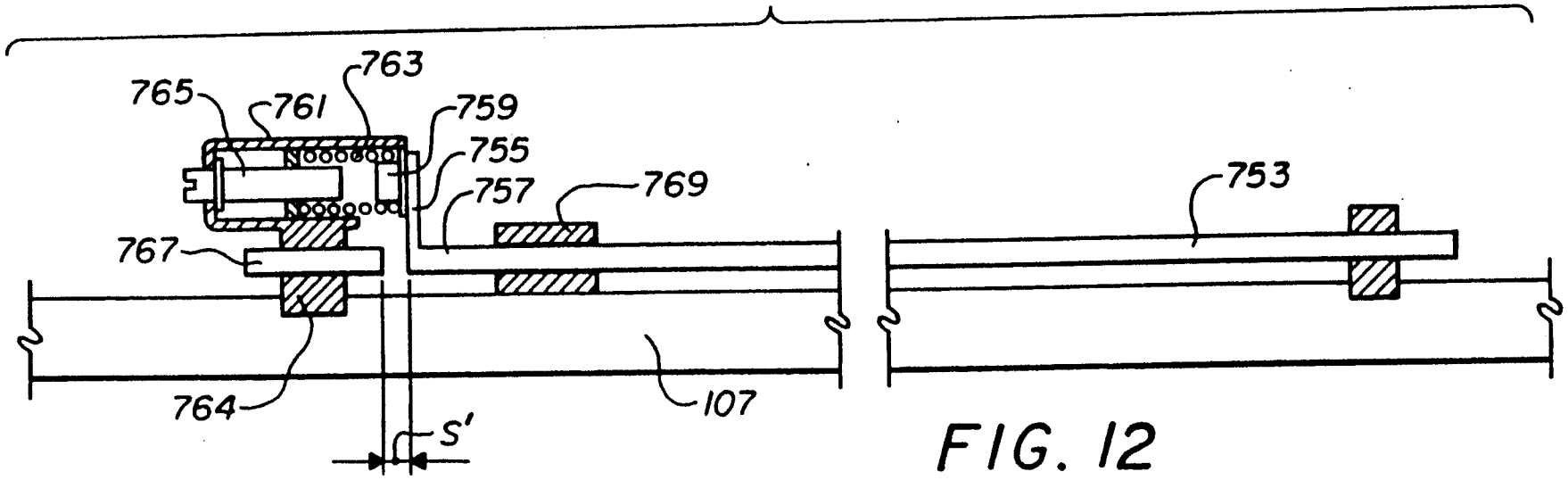
FIG. 12 is a schematic drawing of a form of a ski stiffness system where the impedance means includes both a discrete stop device and a continuously variable device.

A modification of the embodiment shown in FIG. 11 is shown in FIG. 12. Here, a support plate 753 is fixed as described above with respect to FIG. 11, and has a flange 755 attached to forward end 757, with a block 759. A housing 761 holds a spring 763 and control fastener 765, and these all function as corresponding members did in the preceding Figure. Housing 761 rests on a support 764 which is fixed to ski 107. A stop 767 extends through support 764 opposite plate 753. A space S' exists between the rearward end of stop 767 and the forward end 757 of plate 753. The stiffness of the ski is continuously adjustable by means of fastener 765 and the compression of spring 763. In addition, the ski also becomes stiff during curves when end 757 of plate 753 contacts stop 767. Stop 767 could be adjustable, and could be moved away from plate 753 so that these members do not contact each other at all, or less frequently, as for example in powder snow. Stop 767 can thus be spaced from plate 753 by an intermediate amount so that end 757 and stop 767 only contact during curves as described previously. Stop 767 could also be adjusted to contact end 757 to allow the skier to stiffen the ski under the assembly to a maximal value. Forward end 757 slides relative to ski 107 through clamps 769.

Figure 13:
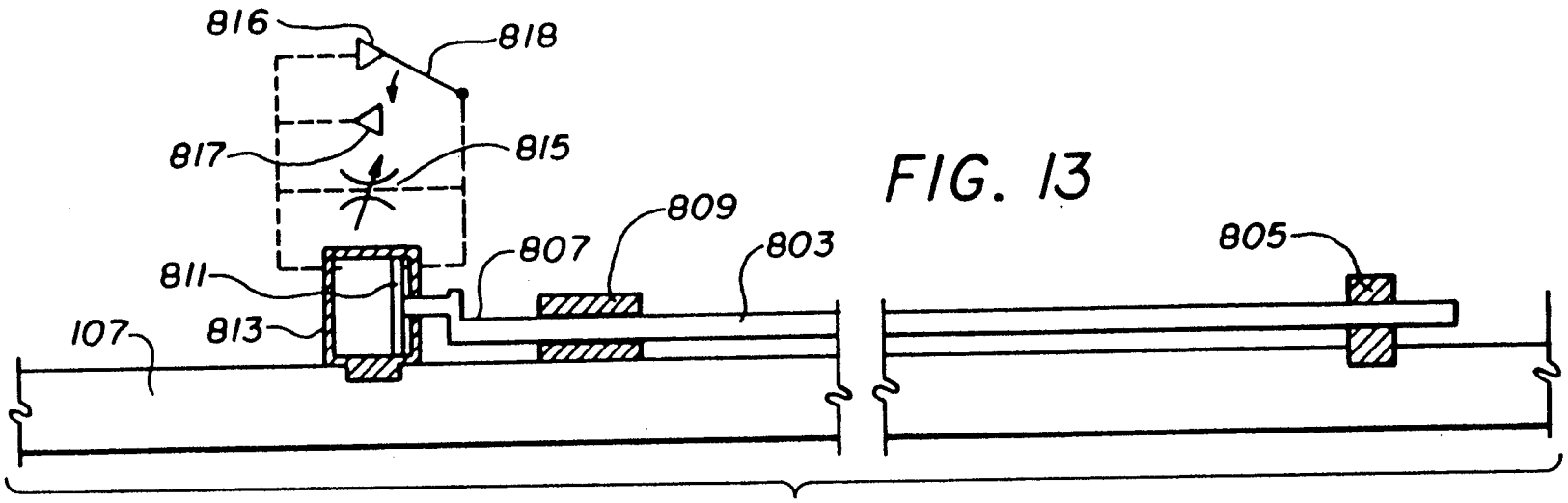
FIGS. 13 and 14 are schematic drawings of a ski stiffness system where a hydraulic system comprises the impedance means.
Figure 14:
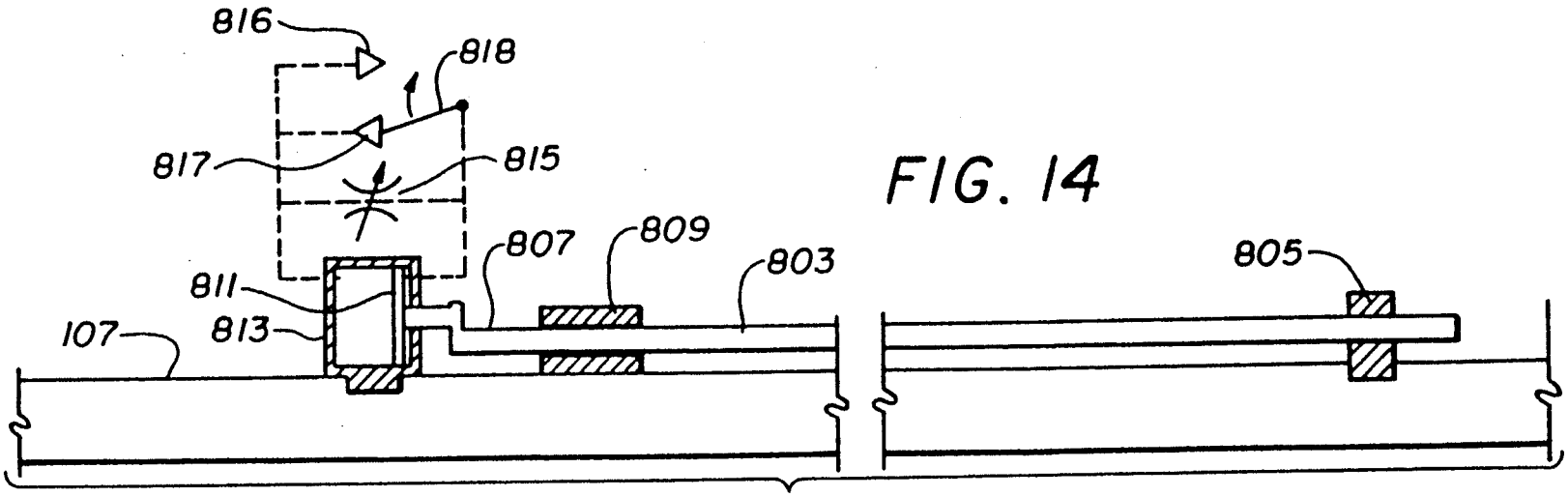

Hydraulic embodiments are shown in FIGS. 13 and 14. In these Figures, support plates 803 are fixed at one end to the ski by anchors 805. The free end 807 is slidable in a clamp 809 attached to ski 107 as the ski bends longitudinally. The free end 807 of plate 803 is attached to a piston 811 slidable in a fluid cylinder 813, which is part of a hydraulic circuit. Cylinder 811 is fixed to ski 107. The part of the cylinder chamber forward of piston 811 is connected by fluid lines to an adjustable valve 815, a selected one of oppositely directed, uni-directional valve heads 816, 817 and a manual fluid valve selector 818 connected to a fluid line for the fluid in cylinder 813 on one chamber or side of piston 811. When the system is set up as shown in FIG. 13, as the ski bends or flexes, forward end 807 and piston 811 move rapidly through the chamber in cylinder 813 since fluid is forced from the cylinder through fast flowing, one way or uni-directional valve head 816, through valve selector 818 and into the side of the cylinder chamber behind piston 811. In this configuration the ski can flex downwardly freely and easily since piston 811 encounters little resistance in its forward movement. When the downward loads which caused the ski to flex are reduced—such as the end of a turn—the ski will tend to return to its normal flex state as fluid flows from the right hand side of cylinder 813, through adjustable valve 815 and into the cylinder on the left hand side of piston 811. The rate of counterflexing will be determined by the adjustment of adjustable valve 815. The counterflex speed of the ski can thus be adjusted by the setting of valve 815, and the counterflex can be dampened.

In FIG. 14, valve selector 818 is operatively connected to uni-directional valve head 817. Now when the ski flexes, free end 807 forces piston 811 to the left, and fluid flows through adjustable valve 815; this is generally a slow flow rate depending on how valve 815 is adjusted. During counterflex, the fluid moves very quickly from the right side of piston 811, through one way valve 817 so that the piston returns quickly to the embodiment shown in FIG. 14. This is good for the free and easy counterflexing movement of the ski.

Figure 15A:
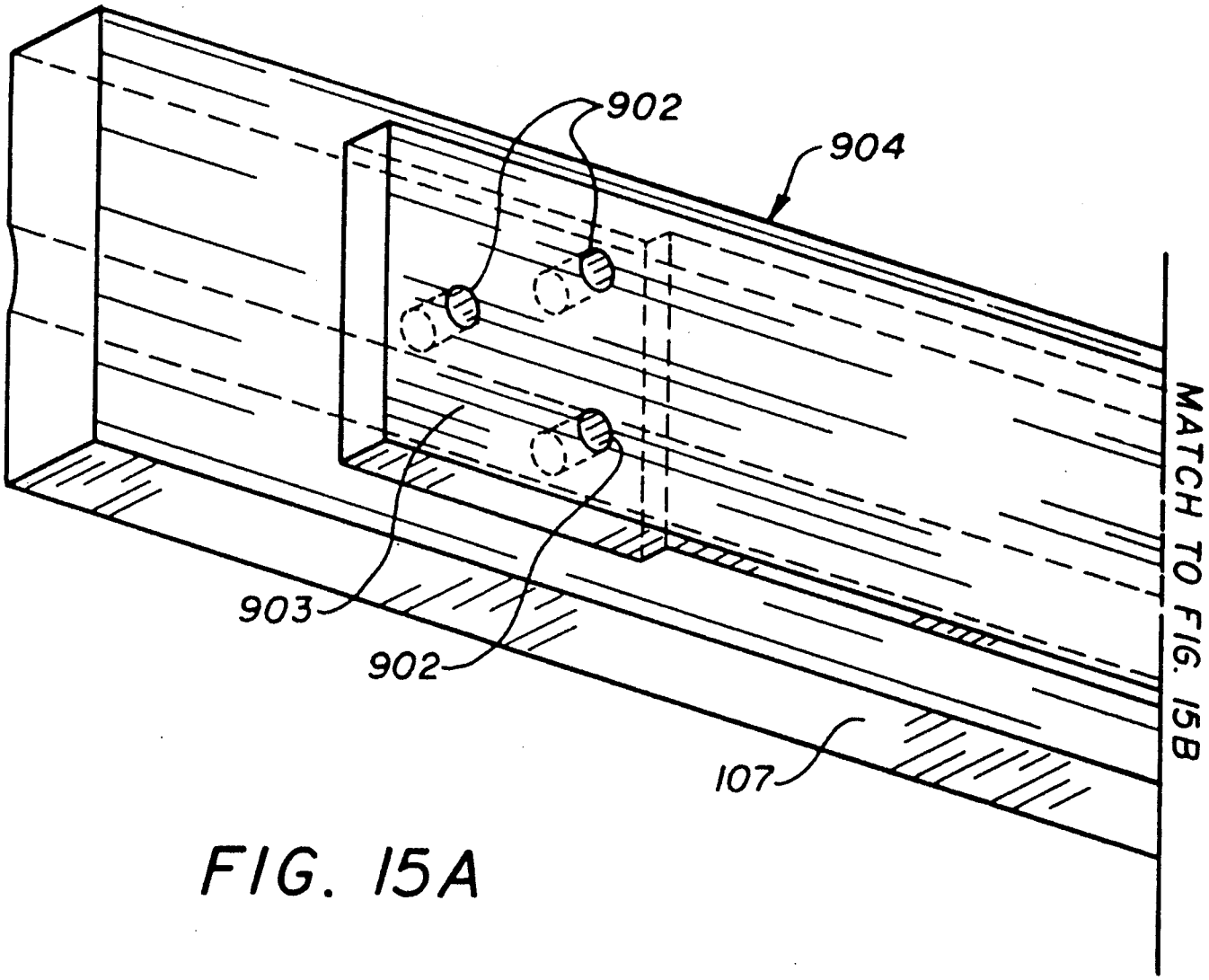
FIGS. 15A and 15B are exploded isometric views of rearward and forward portions of a support plate assembly mounted on a portion of a ski, with the cover plate displaced from the assembly to make the components of the assembly more straightforward.
Figure 15B:
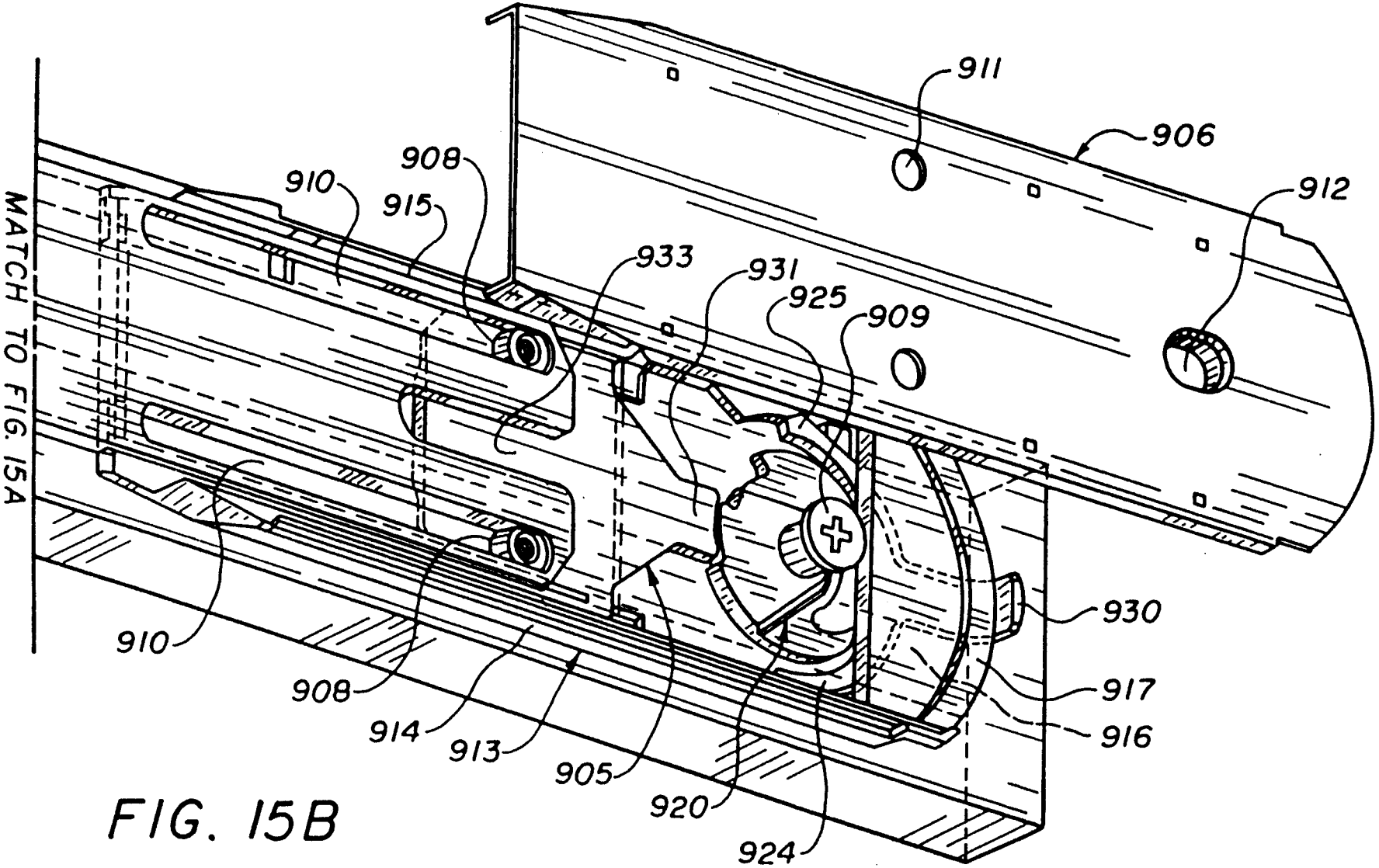

FIGS. 15A and 15B are partial exploded isometric views of a support assembly mounted on a portion of a ski 107. As shown, the support assembly comprises a support plate main member, generally 904, and a support plate slide member, generally 905. The main member 904 and its attached slide member 905, may from time-to-time be referred to as the support plate. The rearward end 903 of the support plate main member 904 is somewhat thicker than the rest of the main member allowing the forward portion of the main member to be spaced from the underlying ski 107. The rearward end of the support plate main member is provided with screw holes 902 for purposes of mounting the main member to the ski and to permit the heel portion of a ski binding to be mounted on the support plate.

The support plate main member 904 is connected to the support plate slide member 905, and to the cover plate, generally 906, by means of attachment screws, not shown, which pass through screw holes 911 and which are threaded into threaded bushings 908 attached to slide member 905.

As will be seen, the end of the support plate main member 904 opposite the rearward end 903 has a bifurcated, forked configuration with slots 910 in each of the forks and with a slot 933 positioned between the forks extending into the main member. The attachment screws referred to hold the support plate main member 904 securely to the support plate slide member 905, minimizing longitudinal movement between the two. However, in a preferred embodiment of the invention, a ribbed surface is provided at the interface between the two members, and in an especially preferred embodiment, an intermediate layer, for example, an elastomeric material, such as ebonite, is positioned as in intermediate layer between the main member and the slide member. Such a layer not only serves to assure that no longitudinal movement between the two members will occur, but provides an additional advantage in that it tends to dampen vibrations transmitted from the ski to the binding.

In the embodiment shown, the support plate slide member 905 is tapered toward the front, culminating in an abutment member 931 which serves to engage a peripheral edge of a control cam disc 920 which serves as an adjustment member or adjustment stop, as will be explained in more detail in the following. The cam disc can be pivoted about a smooth shanked fastener or special purpose screw 909 to juxtapose different peripheral surfaces to abutment member 931 thereby controlling the amount of bending or flexure of the ski, as will also be explained in more detail hereinafter. A head or cam setting lever 930 is employed to position the cam disc as desired, while resilient lugs 924 and 925 are provided to maintain the cam disc in the selected position.

Figure 18:
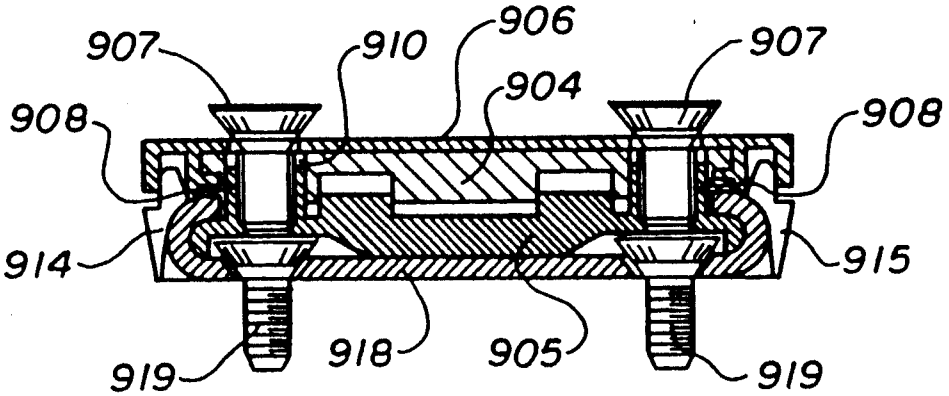
FIG. 18 is a cross-section of the support assembly along line XVIII—XVIII of FIG. 16.
Figure 16:
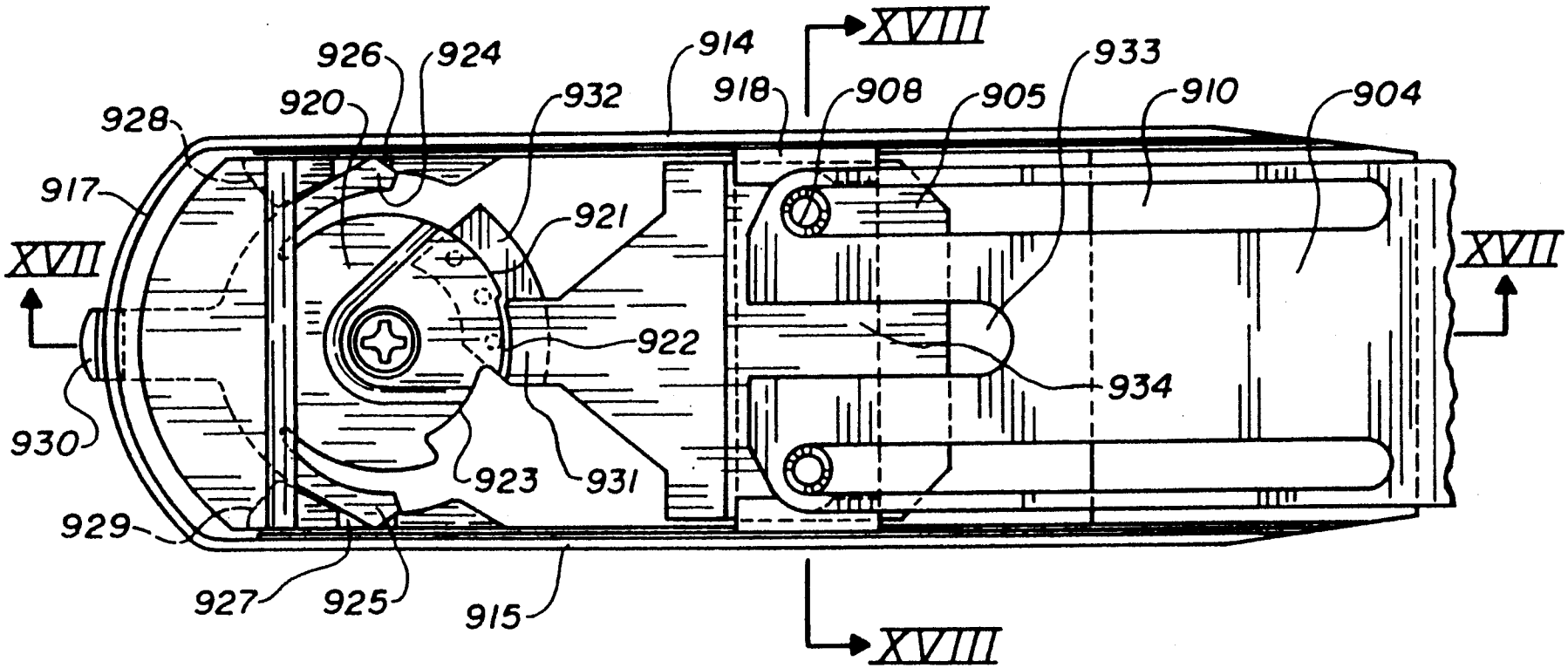
FIG. 16 is a plan view of the support assembly of FIG. 15 without a cover plate.
Figure 17:
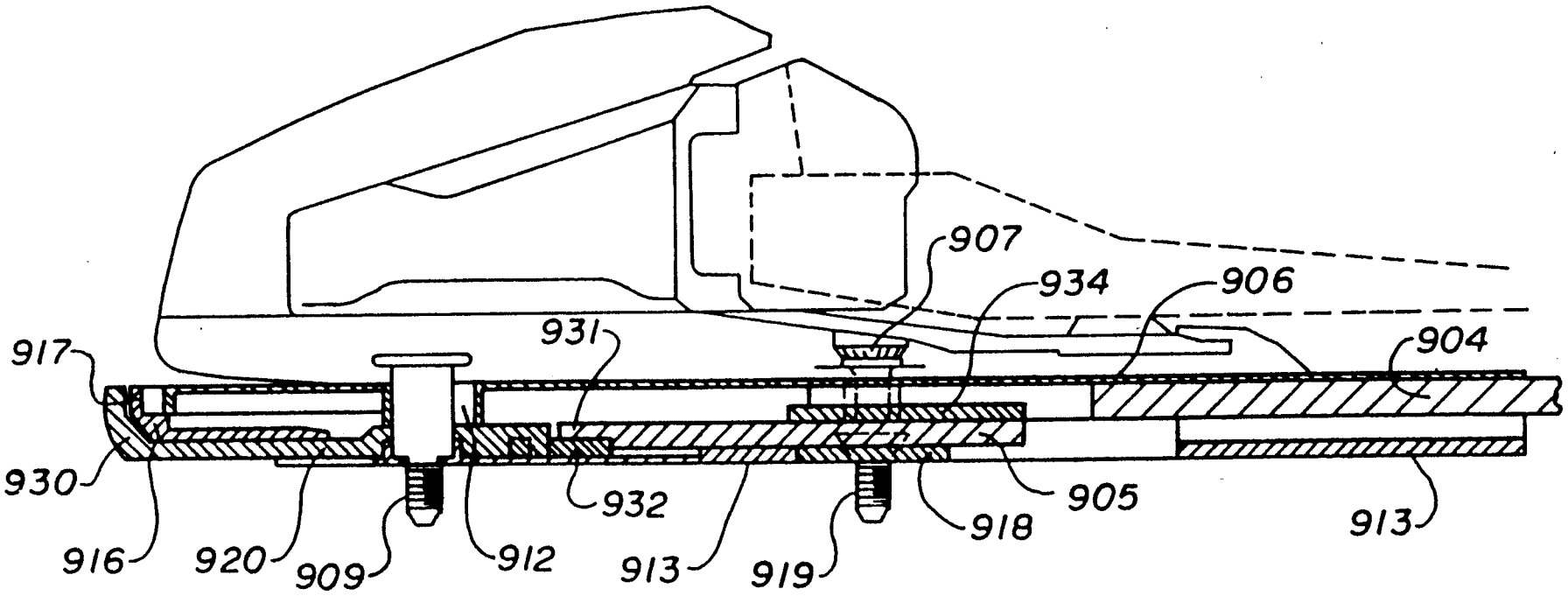
FIG. 17 is a cross-section of the support assembly along the line XVII—XVII of FIG. 16.

A portion of the support assembly, together with the cam disc and other associated structure are positioned between a base plate 913 having lateral edges 914 and 915, and the cover plate 906, which together serve to form a protective housing for parts of the mechanism. The forward ends of the base plate act as a guide for the pivoting movement of the cam disc 920, as will be better seen in FIG. 17. (FIGS. 16–18 are enlarged from that of FIG. 15 for the purpose of clarity). Slot 912 in the cover plate 906 accommodates movement of the forward end of the support plate which occurs during flexure of the ski.

While the back end of the support plate, specifically the rearward end of the support plate main member 903, is fixed to the ski and thus immovable, the forward end of the plate, namely, the slide member portion 905, which is supported by a slide bearing yoke, better seen in the other Figures, is free to move backward and forward, relative to the surface of the ski, thereby accommodating its flexing. The cam disc 920, in conjunction with abutment member 931 serves to control the degree of permissible movement, thereby providing a means to control the degree of flexure or stiffness which the ski is capable of experiencing.

FIG. 16 is a plan view of the support plate of FIG. 15, however, with the cover plate removed in the interest of clarity. The Figure shows the bifurcated forked configuration of support plate main member 904 and its attachment to support plate slide member 905 by means of attachment screws 907 inserted into the threaded bushings 908 extending through forked slots 910, the bushings forming a part of the support plate slide member. Attachment screws 907, which fasten the main member to the slide member, are better seen in FIG. 18.

The support plate slide member 905 is retained in slide bearing yoke 918, but is free to move or slide back and forth therein. As stated, the forward part of the slide member tapers to form a projecting abutment member 931 which is juxtaposed to selected peripheral sections of cam disc 920. Depending upon the clearance between the abutment 931 and the peripheral section, the cam disc either prevents, limits, or allows the essentially uncontrolled longitudinal movement of the forward end of the support plate.

As illustrated in FIG. 16, the abutment member 931 is juxtaposed to a slightly recessed peripheral section 922 of cam disc 920, thereby allowing some degree of forward movement of the abutment to accommodate flexure or bending of the ski. Should the cam disc be rotated counterclockwise to bring the recessed peripheral sections 923 opposite the abutment, substantially unlimited forward travel of the abutment would be possible. However, were the cam disc to be pivoted in a clockwise direction to bring the outer periphery 921 in juxtaposition with abutment 931, essentially no movement of the slide member would be possible, in which case the support plate would act as a stiffening brace for the ski, particularly desirable where a large amount of stiffness is required, for example, during turns on hard snow. The cam disc is moved to its desired position by manipulation of cam setting lever 930. It will be seen that the resilient detents or lugs 924 and 925 engage detent recesses 926 and 927 when the cam disc is in its intermediate position, or, respectively, are located in a position abutting detent projections 928 and 929, locking the cam disc in either its slide member arresting position, or in the position permitting maximum sliding movement. The lateral edges of the base plate are also illustrated in the Figure, as is a forward portion 917 of the base plate. While a cam disc with a periphery having distinct "steps" of different radii has been described, it is also possible for the cam disc to have a periphery whose radius varies in a continuous manner.

FIG. 17 is a cross-section of a support plate along line XVII—XVII of FIG. 16. In this Figure, the front jaw of the safety ski binding can be seen attached to the cover plate 906 and to the support plate main member and support slide member, 904 and 905 respectively. The Figure also shows a ski boot in phantom positioned in the binding. Illustrated in FIG. 17 is the base plate 913 including its front portion 917 and a setback portion 916, which together with the lower portion of the base plate form an opening through which the cam setting lever 930 projects for easy access. A smooth shanked fastener in the form of a screw 909 serves the multiple functions of fastening the base plate to the ski, of serving as a pivot point for the cam disc, and to prevent any lifting or lateral movement of the forward part of the ski binding's front jaw. As previously indicated, the pivot fastener slot 912 accommodates the back and forth movement of the cover plate, which it will be remembered is attached to the main member and slide members of the support plate during flexure of the ski.

Referring again to FIG. 16, a useful feature whose function is better seen in FIG. 17, is to be found in the positioning of an elastomeric pad or plate 932 between a portion of the peripheral edge surface of the cam disc 920, and a surface of abutment member 931. As shown, the positioning of the pad can be accomplished by attaching it to the cam disc by pins located on the cam disc, over which the pad is secured by means of holes located in the latter. As is seen particularly clearly in FIG. 17, before the abutment member 931 can make contact with the peripheral edge of the cam disc 920, it must compress the elastomeric pad. The resistance of the pad to such compression exerts a desirable dampening affect which resists flexing of the ski to a degree determined by the resiliency of the pad. The pad may be disposed over one or more of the recessed peripheral sections of the cam disc to obtain the dampening function described.

FIG. 18 is a cross-section of the support plate along line XVIII—XVIII of FIG. 16 showing details of the sliding support, which allows the support plate of the invention to accommodate flexure of the ski.

FIG. 18 shows the manner in which the support plate slide member 905 is retained by a U-shaped slide bearing yoke 918, the latter being fastenable to a ski by means of fastening screws 919. The support plate main member 904, together with cover plate 906, is fastened to support plate slide member 905 by means of attachment screws 907 which extend into threaded bushings 908 forming a part of the slide member. The lateral edges 914 and 915, respectively, of the base plate enclose the slide bearing yoke 918 and their upper ends are offset inwardly at the top to function as guide rails for the cover plate 906 so that the cover plate, together with the front jaw may slide during ski flexure in relation to the base plate along the longitudinal axis of the ski. As is clear from the Figure, the lateral edges of the base plate, in conjunction with the cover plate, form a housing about a portion of the support plate assembly, protecting the parts thereof from damage and dirt which might otherwise be adventitiously introduced.

As shown in FIG. 17 and FIG. 18, the attachment screws 907 and 919 are positioned coaxially to each other. This is of considerable advantage since it makes it possible to employ the same drilling template for locating the support plate attachment holes in the ski, as is used for installing the safety ski binding screws.

In installing the support plate of the invention, the slide bearing yoke 918 is first screwed to the ski. The support plate slide member 905 is thereafter inserted into the yoke, and the base plate is placed thereon and positioned as desired. Thereafter, the rear end 903 of the support plate main member with the heel part thereon is fastened to the ski.

The forked slots 910 in the support plate main member 904, which have the threaded bushings 908 of the slide member 905 fitted therethrough, allow the positioning of main member 904 to slide member 905 to accommodate whatever length of ski boot sole is to be used in the ski binding. In this connection, boot adjustment slot 933 is provided to accommodate the shank portion of fastener 909 in instances where the ski boot sole is extremely short.

After placement of the support plate main member 904, the cover plate 906 is placed in position and smooth shank fastener 909 screwed into the ski. The front jaw is then placed on the cover plate in position and attachment screws 907 are screwed into the threaded bushings 908, simultaneously connecting support plate main member 904 to slide member 905, preventing their longitudinal movement relative to each other.

With the support plate installed as described, the cam disc 920 is adjusted to the position desired. In regard to such adjustment, as long as the support plate slide part 905 is free to slide in the slide bearing yoke 918, there will be no stressing of the ski, which will be free to flex or bend in conformity to the terrain over which it is passing. The cover plate 906 and the front jaws participate in such movement since the parts are connected together as indicated. Where the elastomeric pad 932 is present, however, such displacement will occur against the resistance of the pad which functions as a dampening element.

An elastomeric pad 934 is attached such as by some appropriate adhesive to slide member 905, to dampen the vibration between member 905 and main member 904 during skiing. Such vibration dampening means can be applied between any horizontally disposed units in the system.

Figure 19:
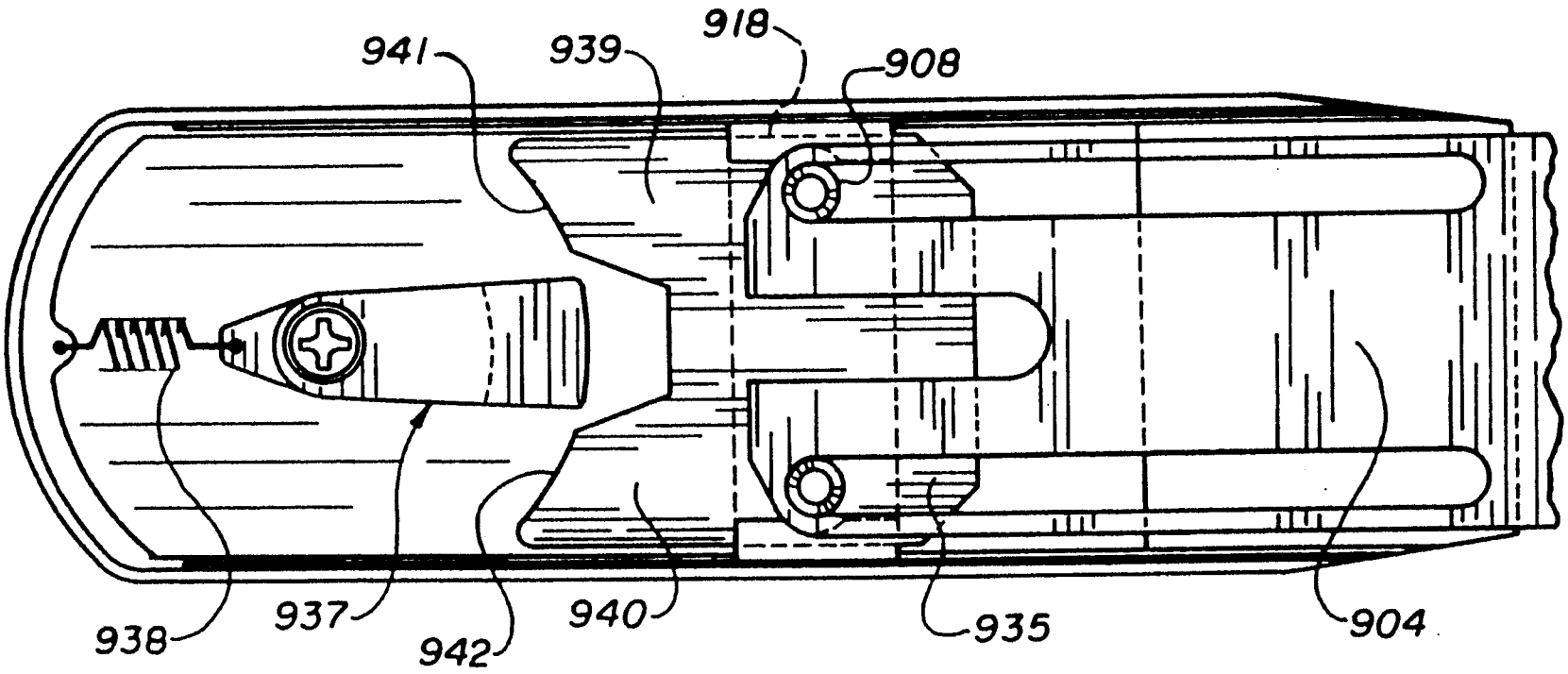
FIG. 19 is a plan view of a different stiffening system, without a cover plate.

FIG. 19 is a plan view of a further embodiment of the support plate shown without a cover plate, with like parts to those shown in FIGS. 15–18 having like numerical designators. As illustrated, a support plate main member 904 is fastened to a support plate slide member 935 by means of attachment screws 907, not shown, inserted into threaded bushing 908. The support plate slide member 935 is retained in slide bearing yoke 918, being free to slide therethrough, and is bifurcated at its unattached end having forks 939 and 940 located thereon. The forks are provided with fork abutment surfaces 941 and 942, respectively, adapted for juxtaposition to surface 943 to the free end 944 of pivot arm 937 which serves as an abutment or control member, or abutment stop. The opposite end of the pivot arm is attached to spring 938 whose other end is anchored, for example, to base plate 936, better seen in FIG. 20.

In this embodiment, the pivot arm or abutment stop itself cooperates in limiting the amount of longitudinal movement of which the support plate slide member is capable. In this regard, the inertial force acting on the free end 944 of the pivot arm, for instance, when the ski is running on its edge, serves to automatically pivot the arm so that the outermost radial surface 943 of the free end of the pivot arm 937 pivots to a point at which it is juxtaposed to either fork abutment surface 941 or 942, where it acts to restrain their movement. The pivoting motion acts against the force imposed by the weak spring 938; however, when the inertial force is no longer operable, the spring acts to realign the pivot arm along the longitudinal axis of the ski.

Advantageously, the juxtaposed surfaces of abutment surfaces 941 and 942, as well as the outermost radial surface 943 of pivot arm 937 having mating curved surfaces which conform to a radial arc whose center is the pivot point of the pivot arm 937.

Figure 20:
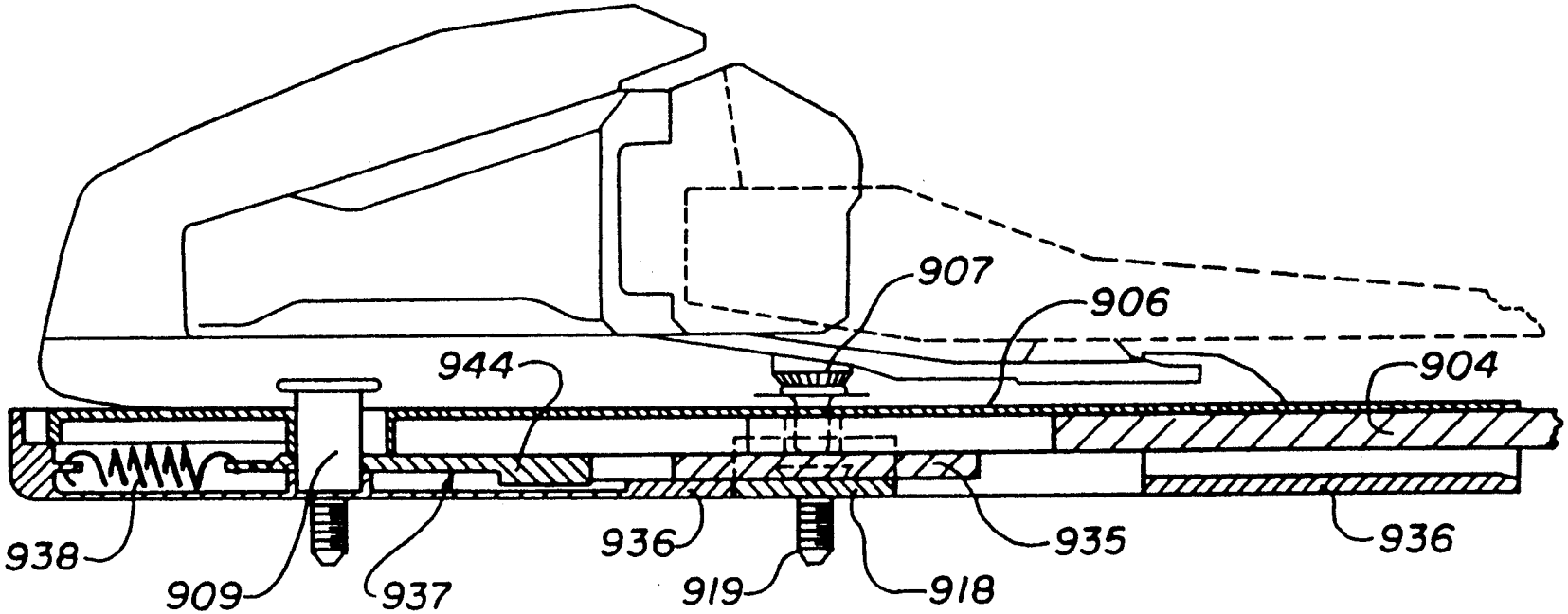
FIG. 20 is a cross-section of the previous device taken along the longitudinal centerline of FIG. 19.

FIG. 20 is a cross-section view of a support plate along the longitudinal centerline of FIG. 19. The construction of the pivot arm or adjustment stop is much the same as that previously described in connection with FIGS. 15 through 18, the support plate main member 904 being connected to the support plate slide member 935 by means of attachment screws 907, which engage the threaded bushing 908 disposed in the fork slots of the bifurcated end of the support plate main member 904. The slide member 935 is retained in slide bearing yoke 918, which in turn is fastened to a ski by fastening screws 919. The pivot arm 937, pivotable about the smooth shanked fastener 909 which also fastens base plate 936 to the ski, is urged into a longitudinal position, relative to the ski, by weak spring 938 anchored to the base plate 936. The Figure illustrates the thickened section of the pivot arm 944, not only adds inertial mass to the arm, but also provides the necessary surface area 943 at its end to efficiently engage the forked abutment surfaces 941 and 942, respectively.

The jaws of the binding and cover plate 906 are fastened to the assembly by attachment screws 907, as previously indicated, while the front end of the jaws are prevented from upward and lateral movement by the smooth shanked fastener 909.

If desired, provision may be made for moving the pivot arm 937 along the longitudinal axis of the support plate assembly to allow the clearance between surfaces 941 and 942 with surface 943 to be adjusted in a way allowing more or less movement of the support plate slide member 935, thus adjusting the freedom of the ski to flex.

As will be appreciated, the support plate slide member is free to slip back and forth through the slide bearing yoke 918 so long as the ski is moving in a direction of the fall line of the slope, a condition in which no stiffening of the ski adjacent to the support plate will occur. On the other hand, when the ski is moved into a turn, a condition in which inertial force acts on the pivot arm 937, the arm will swing out of the intermediate position illustrated in the Figure, the surface 943 of its free end thereupon being juxtaposed with one of the abutment surfaces 941 or 942. In this position, the movement of the slide member 935 is restrained, preventing flexing of the ski and allowing short, rapid turns to be accomplished with precision, even on hard snow.

Figure 21:
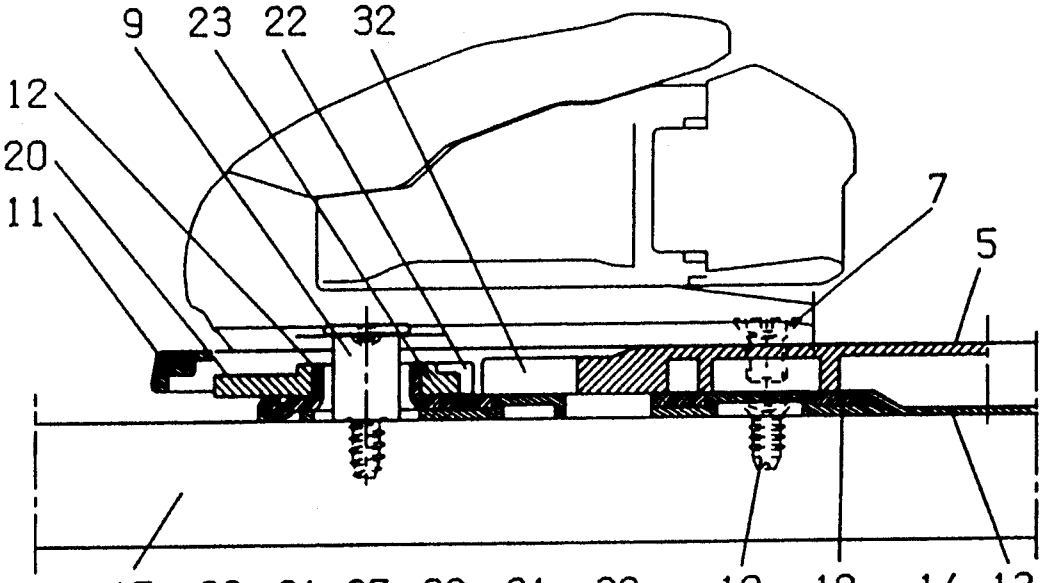
FIG. 21 is a cross-section of an end of a support plate assembly of an embodiment of the invention supporting the front jaw of a safety ski binding.

Referring now to the preferred embodiment of the invention, FIG. 21 shows a ski 17 with a base plate 13 mounted thereon. A bearing yoke 18 is positioned on the base plate, being fastened to the ski by means of screw fasteners 19. A front jaw of a ski binding is connected to support plate slide member 5 by attachment screws 7 which are threaded into threaded bushings 8, better seen in FIG. 22. Extending from the support plate slide member 5 is shown a resilient finger 32, adapted to possibly engage the peripheral section of cam disc 20. Finger 32 is one of a number of fingers adapted to possibly engage the projecting peripheral sections of cam disc 20, as will be described in more detail in the following. The cam disc 20 is fastened to ski 17 by a smooth shanked fastener 9, passing through bushing 12 which serves as a swivel shaft for pivoting cam disc 20. In addition to peripheral section 22 projecting from cam disc 20, the cam disc also includes a recessed peripheral section 23, as well as other projecting sections, each of the sections playing a part in the functioning of the cam disc in its various positions, as described hereafter. The front jaw of the ski binding is free to move longitudinally with the end of the support plate slide member 5.

Not shown in the Figure, but forming a part of the embodiment, is a support plate main member which is variably fixable to support plate slide member 5 to accommodate whatever length of ski boots sold is to be used in the ski binding. The support plate main member carries the heel portion of the ski binding.

Figure 22:
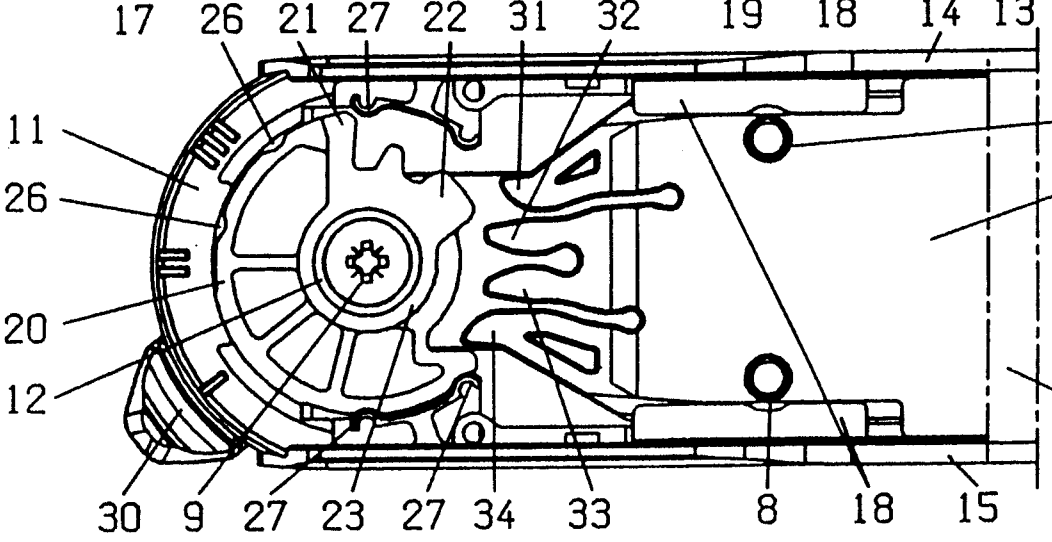
FIG. 22 is a plan view of the end of the support plate assembly according to FIG. 21, but with the front jaw of the safety ski binding removed therefrom.

FIG. 22 is a plan view of the end of the support plate assembly according to FIG. 21, but with the front jaw of the safety ski binding removed therefrom. In the Figure is shown support plate slide member 5 from which extend a plurality of resilient fingers 31, 32, 33 and 34. Opposite the ends of the fingers is a cam disc 20 mounted to the ski by smooth shanked fastener 9 which passes through bushing 12, the cam disc being free to rotate thereabout as it is moved between its various settings, which are identified as I, II and III, as shown. The movement of the cam disc 20 between its various settings is accomplished by movement of lever 30, the cam disc being held in the selected setting by the action of detents 27 which engage recesses 26 in the cam disc. The cam disc has a number of peripheral sections projecting therefrom including sections 21 and 22, as well as an optional intermediate peripheral section 10 located between the aforesaid sections, projecting outwardly from the cam disc. The cam disc 20 also includes a recessed peripheral section 23. The rigidity of the ski is determined by the presence or absence of engagement between one or more of the peripheral sections with one or more of the fingers forming part of the support plate slide member 5.

The Figure also shows bushings 8 adapted to receive the fastener screws 7 which hold the front jaw of the safety ski binding to the support plate slide member 5. The support plate slide member 5 is free to move back and forth in a bearing yoke 18, which is carried by base plate 13, essentially T-like in its configuration, and which serves to guide the support plate slide member in its movement resulting from flexing of the ski. The two sides of the bearing yoke 18 are bent inwardly to retain the support plate slide member 5 within the yoke. The bar of the "T" has bushing 12 located therein, which serves as the swivel shaft for control cam disc 20, as previously described.

Base plate 13 is configured with upwardly bent edges 14 and 15 along its longitudinal sides, and a bridge 11 at the front end of the base on which the identifying number settings previously referred to are located. Lever 30 projects under the bridge 11, and in the Figure a recessed peripheral section 23 of the disc is juxtaposed to the fingers 32, 33 and 34, while peripheral section 22 is spaced from finger 31, the positioning described allowing an essentially unlimited forward movement of the support plate slide member 5 to accommodate bending of the ski 17.

The fingers 31, 32, 33 and 34 will desirably be made from a resilient material, particularly a resilient plastic material. While any plastic material capable of resiliently moving under the influence of engaging contact of the fingers with the peripheral sections of the cam disc is suitable for purposes of the invention, plastics such as, for example, acetal resins, which may be reinforced by glass fibers or other materials, are particularly adapted for use with the invention. One such material is the Delrin acetal resin, marketed by the DuPont company.

Figure 23:
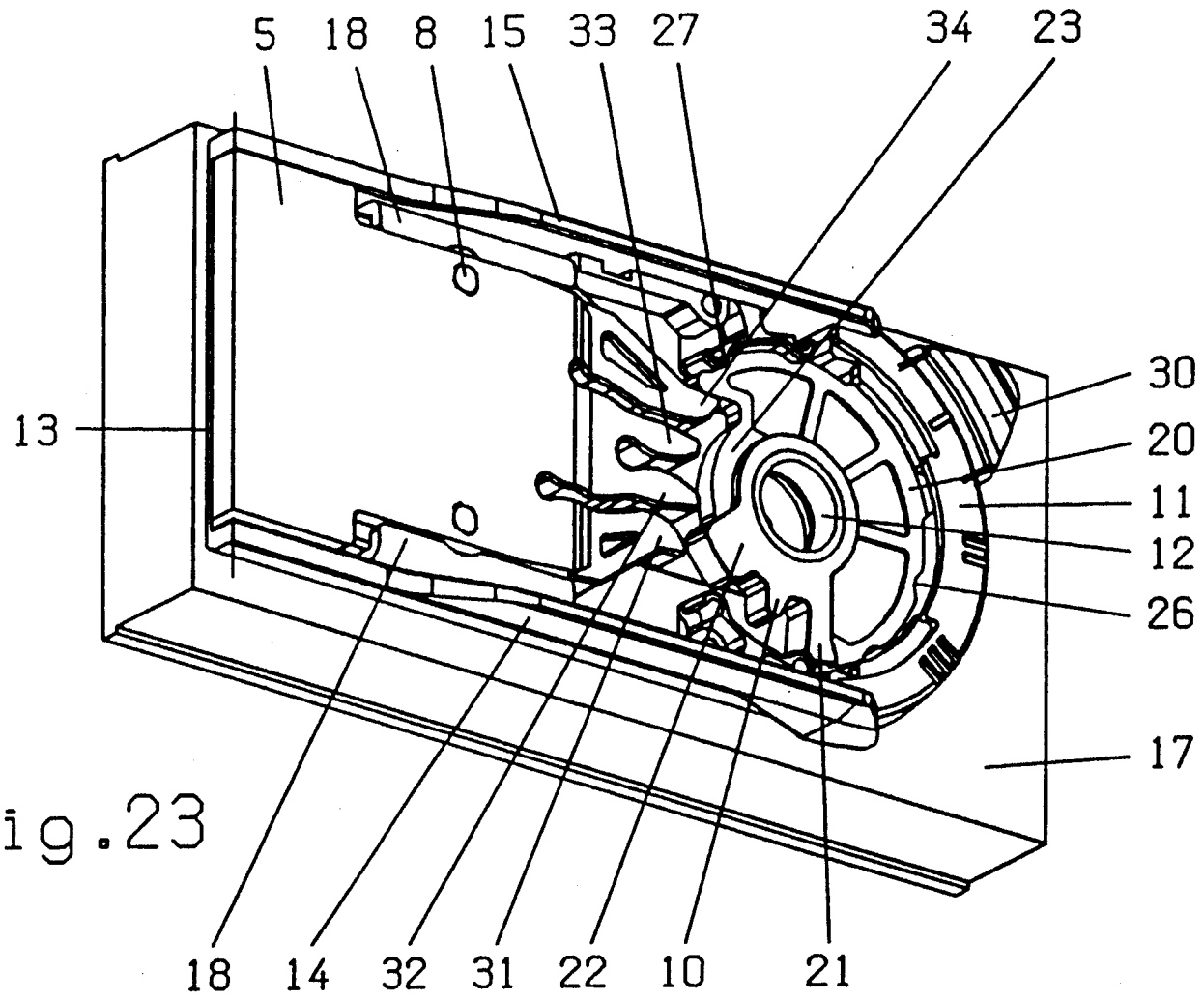
FIG. 23 is an isometric view of the support plate assembly of FIG. 22.

FIG. 23 is an isometric view of the support plate assembly of FIG. 22. The Figure illustrates the relative positioning of the components. As shown, the support plate slide member 5 moves back and forth within bearing yoke 18, which is positioned over base plate 13, plate 13 having upwardly bent edges 14 and 15 at its longitudinal sides, together with bridge 11 at the forward end thereof.

Detents 27 can be seen engaging recesses 26 on the cam disc 20, which has been moved by lever 30 into setting position I, a setting in which the recessed peripheral section 23 is juxtaposed to fingers 32, 33 and 34 extending from the forward end of the support plate slide member 5. Since finger 31 is spaced from peripheral section 22 in the setting of the cam disc shown, an essentially unlimited forward movement of the support plate slide member 5 can occur in accommodating bending of the ski 17.

Figure 24:
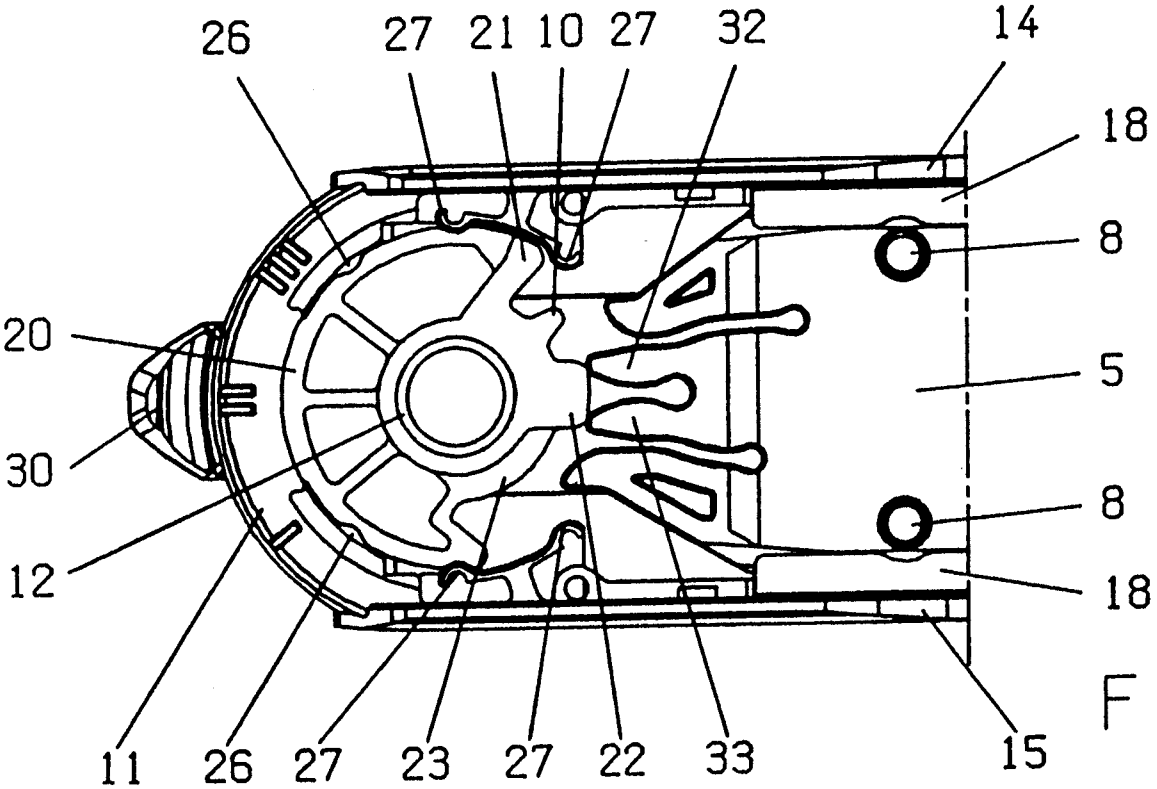
FIG. 24 is a plan view of a support plate assembly of the invention disposed in a reinforcing position different from that shown in FIG. 22.

FIG. 24 is a plan view of the support plate assembly of the invention, disposed in a different setting position of cam disc 20. As shown, the support plate slide member 5, which is positioned in bearing yoke 18 and provided with bushings 8 for attachment of the toe piece of a ski binding thereto, has resilient fingers 32 and 33 in operative engagement with peripheral section 22 of cam disc 20. Peripheral sections 10 and 21 of the cam disc, the presence of the former being optional, are unengaged in the position, which reflects movement of the lever 30 into the setting position of intermediate rigidity, position II of the device. The cam disc is held in the position shown by the engagement of detents 27 with corresponding recesses 26 on the cam disc 20. The bearing yoke 18 is positioned between upstanding sides 14 and 15 of base plate 13, which is also provided with bridge 11.

In setting II, as bending of the ski takes place, support plate slide member 5 is moved forwardly against the surface of peripheral section 22, causing the peripheral section to slide along the tapered inner edges of fingers 32 and 33. This movement which acts as a retardant to movement of the support plate slide member 5, forces fingers 32 and 33 laterally apart, acting to rigidify or stiffen the ski. As additional bending of the ski occurs, forcing the support plate slide member 5 to move still further in a forward direction, to the left in the Figure, the lateral spreading of fingers 32 and 33 proceeds to the point at which their outside edges engage the inner surfaces of fingers 31 and 34, respectively. The reinforcement provided by this latter engagement resists the forward movement of the support plate still further, adding to the stiffness of the ski.

Figure 25:
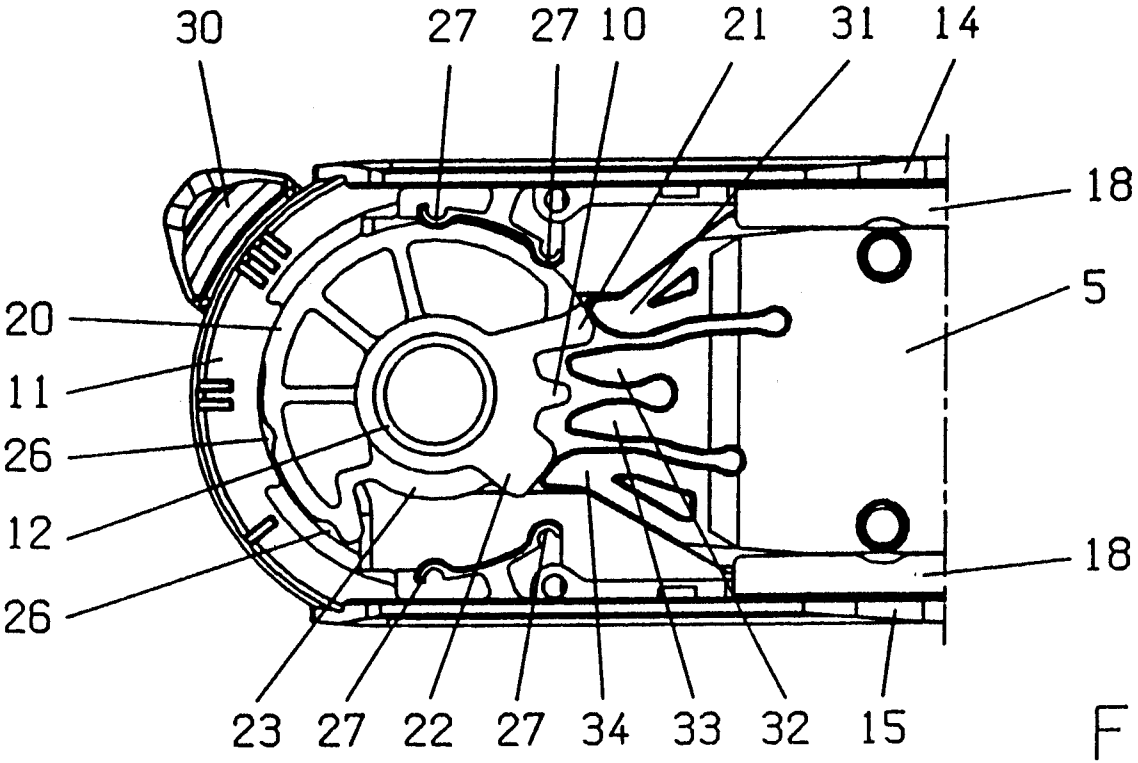
FIG. 25 is a plan view of the support plate assembly of the invention disposed in yet another reinforcing position.

FIG. 25 shows a plan view of the support plate assembly of the invention disposed in yet another positional setting. In the Figure, support plate slide member 5, positioned within bearing yoke 18 and provided with resilient fingers 31, 32, 33 and 34 extending from the forward end thereof, is positioned opposite cam disc 20 in the device's most rigid position in which the lever 30 has been moved to setting III. In this setting, fingers 31 and 34 are placed in operative contact with peripheral sections 21 and 22 respectively. Again, the cam disc 20 is held in the selected position by the engagement of detents 27 with corresponding recesses 26. While recessed peripheral section 23 plays no part in the setting III, peripheral section 10 is located opposite, but spaced from fingers 32 and 33. As shown, bearing yoke 18 is positioned between the upstanding sides 14 and 15, respectively, of base plate 13, which includes bridge 11 with the setting markings thereon.

Cam disc 20 is moved into the position shown by being pivoted about bushing 12 at the center thereof by means of pressure applied to lever 30.

Inasmuch as fingers 31 and 34 are shaped (as shown), or constructed more rigidly than fingers 32 and 33, their engagement with peripheral sections 21 and 22 results in the support plate slide member 5 encountering more resistance to forward movement as the ski attempts to bend; consequently, the ski is more rigid or stiffer than in the case of either settings I or II. Furthermore, in an optional embodiment, should the forces acting on the ski to cause bending increase beyond the ability of fingers 31 and 34 to resist the same, optionally present peripheral section 10 engages fingers 32 and 33 as the support plate slide member moves additionally forward, resulting in still further resistance to the members forward movement.

In the case of either settings II or III, as the forces tending to bend the ski are removed and the ski unbends, the fingers disengage from the peripheral sections with which they are in contact, resetting the device.

From the preceding, it can be seen that the embodiment shown in FIGS. 21–25 allows the ski to be made more rigid by moving lever 30 progressively through settings I, II and III. Such adjustment moves the rigidifying device illustrated from position I in which resistance to flexure of the ski is essentially non-existent, through setting II which provides two levels of resistance, and finally to the position of setting III, optionally providing two levels of resistance. While the stiffening influence of such settings will depend upon the nature of the fingers, particularly including their shape and dimensions, as an approximation in considering the relativity of the stiffness described, the stiffness of position I would be of a small value (about 10 kg caused by internal friction in a design as shown in the Figures); that of II would have an intermediate and higher level of resistance (35–50 kg in the depicted system); while that of setting III would provide a highest level of resistance (i.e. of about 200 kg in the system shown in the Figures). Different values of resistance can be obtained using different shapes of the fingers.

While only three settings have been described in connection with the embodiment illustrated in connection with FIGS. 21–26, other settings designed to yield still different degrees of rigidity can be provided. This result is readily accomplished merely by providing further points of engaging contact between additional fingers and corresponding additional peripheral sections on the cam disc.

Figure 26:
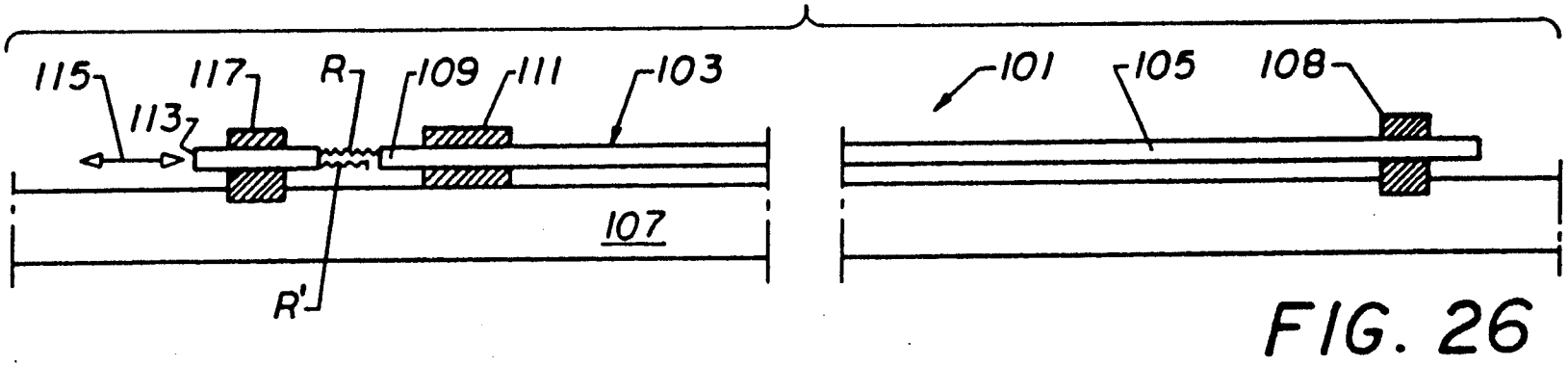
FIG. 26 is a schematic drawing of the support plate assembly embodiment of the invention shown in FIGS. 22–25.

FIG. 26 is a schematic drawing of a support plate assembly embodiment of the invention shown in FIGS. 21–25. In this embodiment, a stiffness control assembly 101 includes an engagement means, which can be a support plate 103, one of whose ends 105 is fixed to the ski 107 by fastening member 108, and its second end 109 is a free end which can slide in the longitudinal direction of ski 107 within guide means such as a support clamp 111. End 109 of plate 103 is shown closest to the forward end of the ski. An impedance means, designated in the Figure as an adjustable stop member 113 is also shown, the adjustable stop member being movable relative to plate 103 and ski 107 within a clamp 117, as indicated by arrow 115.

When the ski is to retain its bending ability unimpaired, the distance between the adjustable stop 113 and the free end 109 of the support plate 103 is adjusted to have a relatively high value, with no connection therebetween. Then, regardless of the degree of bending of the ski 107, plate 103 cannot engage stop 113, and no additional stiffness is imposed on the ski by the support plate 103. When, however, it is intended that assembly 101 minimize the bending of the ski, as for example when the ski is to be turned in hard snow, adjustable stop 113 is set to become engaged with the free end 109 of support plate 103 to a greater or lesser degree of bending of the ski so that there is interaction between the stop 113 and the end 109, the extent of the adjustment selected being dependent upon the snow conditions which determines the rigidity of the ski desirable under the circumstances.

For example, in a position of intermediate rigidity, as provided by the setting position seen in FIG. 24, the engaging force of two resilient fingers 32, 33 is operable against one of the projecting peripheral sections 22 of the cam disc 20. This is represented in FIG. 26 by the initial engaging connection between adjustable stop member 113 (which represents peripheral section 22) and support plate 103 which would result from the connection of the stop member and the end 109 (representing fingers 32, 33) through spring R (representing the resiliency of fingers 32, 33). As the ski undergoes more bending, however, the two fingers 32, 33 referred to could be moved laterally apart to a position in which they contact two additional resilient fingers 31, 34, the latter providing further support to the initially engaged fingers 32, 33, thus increasing the resulting rigidity. In FIG. 26, such additionally imposed rigidity is represented by the movement of support plate 103 to a position at which its end 109 also contacts spring R′ representing the resiliency of fingers 31, 34), thus imposing the rigidity effect of both springs upon the connection.

However, FIG. 26 also represents the case in which the adjustable stop 113 has been positioned in its most rigid position. Here, as shown in FIG. 25, two projecting peripheral sections of the cam 21, 22 initially engage two stiffer resilient fingers 31, 34, respectively, which are stiffer than fingers 32, 33, imposing a degree of rigidity represented in FIG. 26 by the spring R (representing the resiliency of fingers 31, 34), which in this case has a higher relative value of rigidity than in the initial position of intermediate rigidity (fingers 32, 33) described above. In an alternative construction, when the ski 107 is subjected to still greater bending, moving support plate 103 with even greater force toward the adjustable stop member 113, the end 109 corresponding to fingers 32, 33, since fingers 31, 34 are already engaged with respective peripheral sections 21, 22) moves toward the adjustable stop member 113 (corresponding to peripheral section 10) to a point which in FIG. 5 is that where an optionally provided third projecting peripheral section 10 of the cam disc 20 is brought into contact with the two resilient fingers 32, 33 described in connection with FIG. 4, increasing the rigidity still further. This additional contact is represented in FIG. 6 by the contact of end 109 (representing fingers 32, 33) with spring R' (representing the resiliency of fingers 32, 33), the point at which the cumulative effect of the resistance of both springs (corresponding to the resiliency of all four fingers) is experienced, thereby imposing maximum rigidity on the ski.

Figure 27:
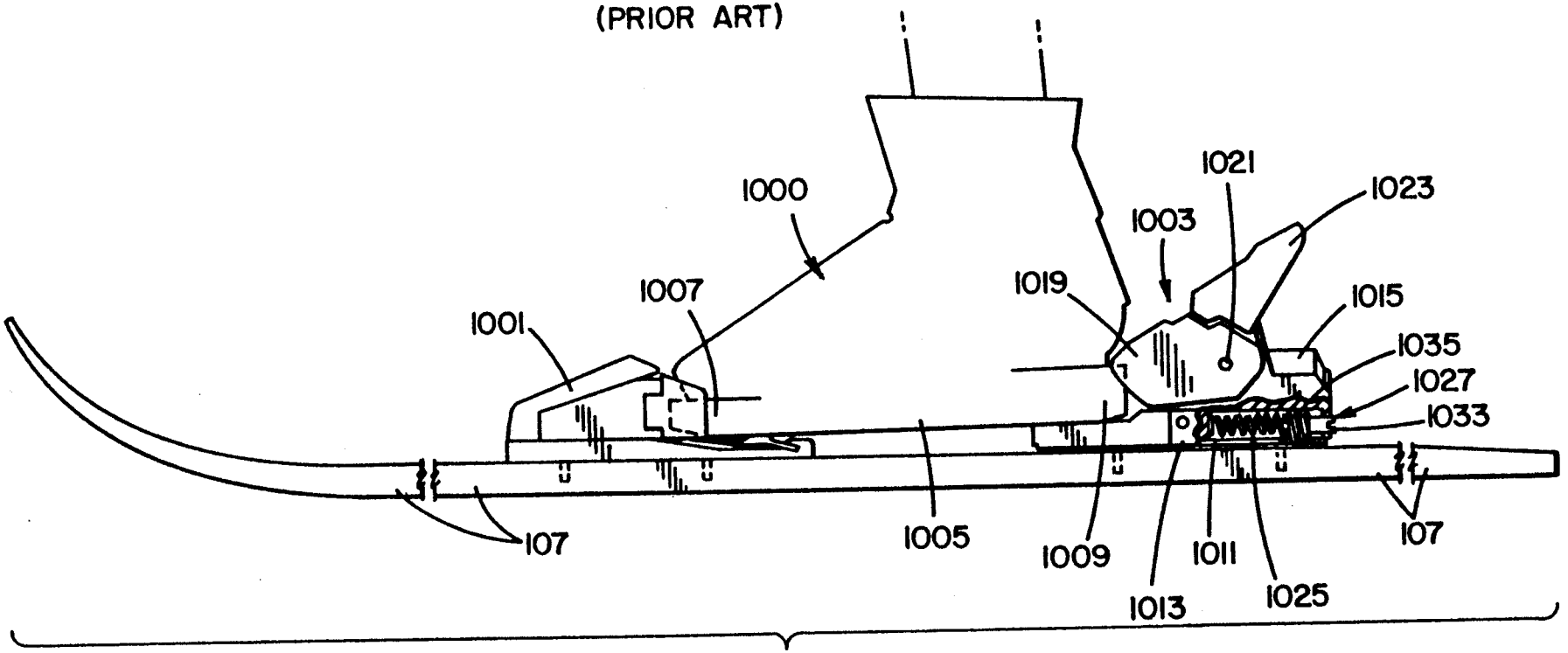
FIG. 27 (PRIOR ART)
FIG. 27 is a schematic drawing of a side of a heel piece according to the prior art, showing ski boot mounted in a ski binding, with the ski binding being shown schematically where parts of the heel piece are omitted to indicate the inside of the binding.
Figure 28:
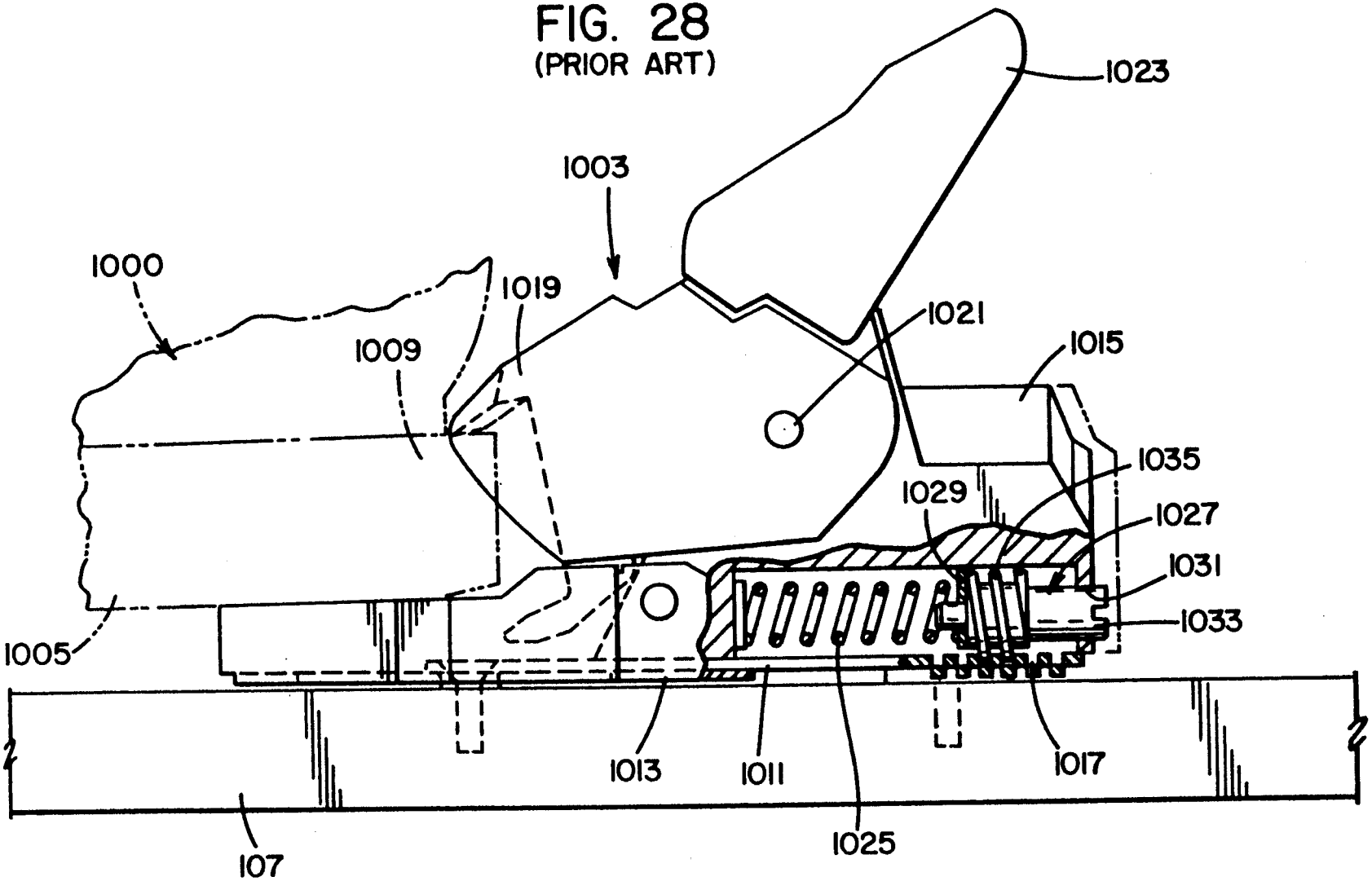
FIG. 28 (PRIOR ART)
FIG. 28 is a side schematic view of a heel piece of a ski binding as shown in FIG. 27, showing the forward pressure spring and the screw assembly for locating that spring in the heel piece.
Figure 29:
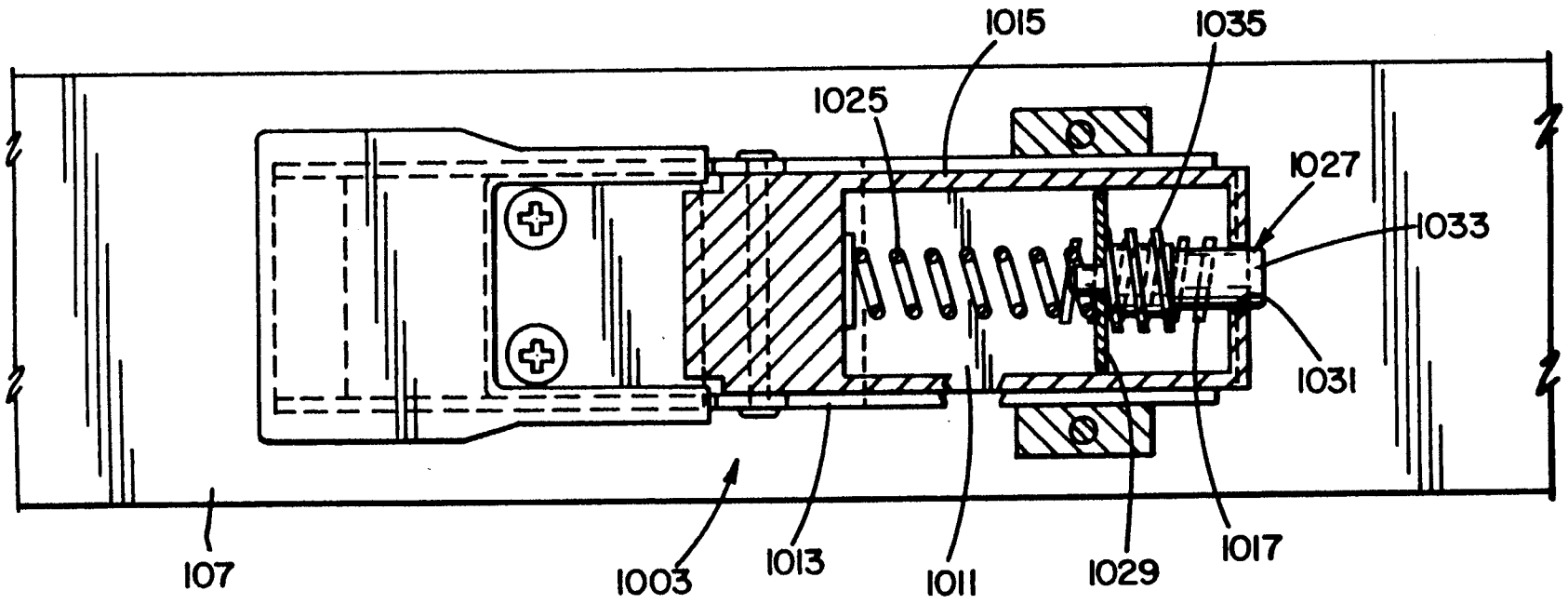
FIG. 29 (PRIOR ART)
FIG. 29 is a top view of the heel piece shown in FIG. 28, with part of the heel piece omitted to more clearly show the internal parts of the ski binding.

FIGS. 27, 28 and 29 show a typical ski binding for attaching a ski boot 1000 with a sole 1005 to a ski 107. The binding includes a toe piece 1001 which is fixed to ski 107 and a heel piece 1003 which is mounted on the ski. The boot has a sole 1005, and is attached to the ski by having its toe portion 1007 engaged by toe piece 1001 and its heel portion 1009 engaged by heel piece 1003. The toe piece 1001 is fixed or stationary on the ski. Heel piece 1003 includes a track 1011 which is fixed to the ski. Track 1011 includes a housing guide 1013 for guiding a housing 1015 (discussed below) for adjustment to different sizes of ski boots, and a screw guide 1017 for the adjustment screw.

Housing 1015 carries a heel holder 1019 which is pivotal about a laterally extending axis 1021, to move between a raised position for receiving a heel of a ski boot and a lowered position (FIG. 28) for holding the boot heel on the ski. The forward position of heel holder 1019, which engages the heel, is closer to the toe piece when it is in the lowered position rather than it is in its raised position. A handle 1023 is operatively attached to heel holder 1019 for manually opening the heel holder, by pivoting the heel holder 1019 about axis 1021 and releasing the release spring (not shown). Housing 1015 further carries a forward pressure spring 1025 which is compressed when a boot is being held and urges the heel holder 1019 forward, to urge the boot sole 1005 into toe piece 1001.

The housing 1015 can be moved forward or backward in track 1011 by the adjustment of a screw assembly 1027 which urges a spring abutting plate 1029 forward. Screw assembly 1027 is fixed at any of its settings to the ski. An aperture 1031 into which a head 1033 of screw 1035 of screw assembly 1027 can slide is provided, since housing 1015 is movable backward over the screw assembly as a boot is locked into the ski, and is also movable longitudinally relative to the screw assembly 1027 as the ski bends.

As the ski is flexed or bent with the forward and rearward end sections of the ski bent upward, a boot sole mounted in a binding stiffens the ski against bending, and so does the forward pressure spring 1025 because it exerts a biasing force on the sole towards the toe piece. Using different forward pressure springs changes the stiffness of the binding, and adjustment of screw 1035 beyond its normal setting also changes the stiffness when the boot is mounted in the binding on the ski. The inventor has found that by adding a variable biasing means to the sole holder, the stiffness of the ski can be varied to obtain benefits of different stiffness of the ski for different skiing conditions.

Figure 30:
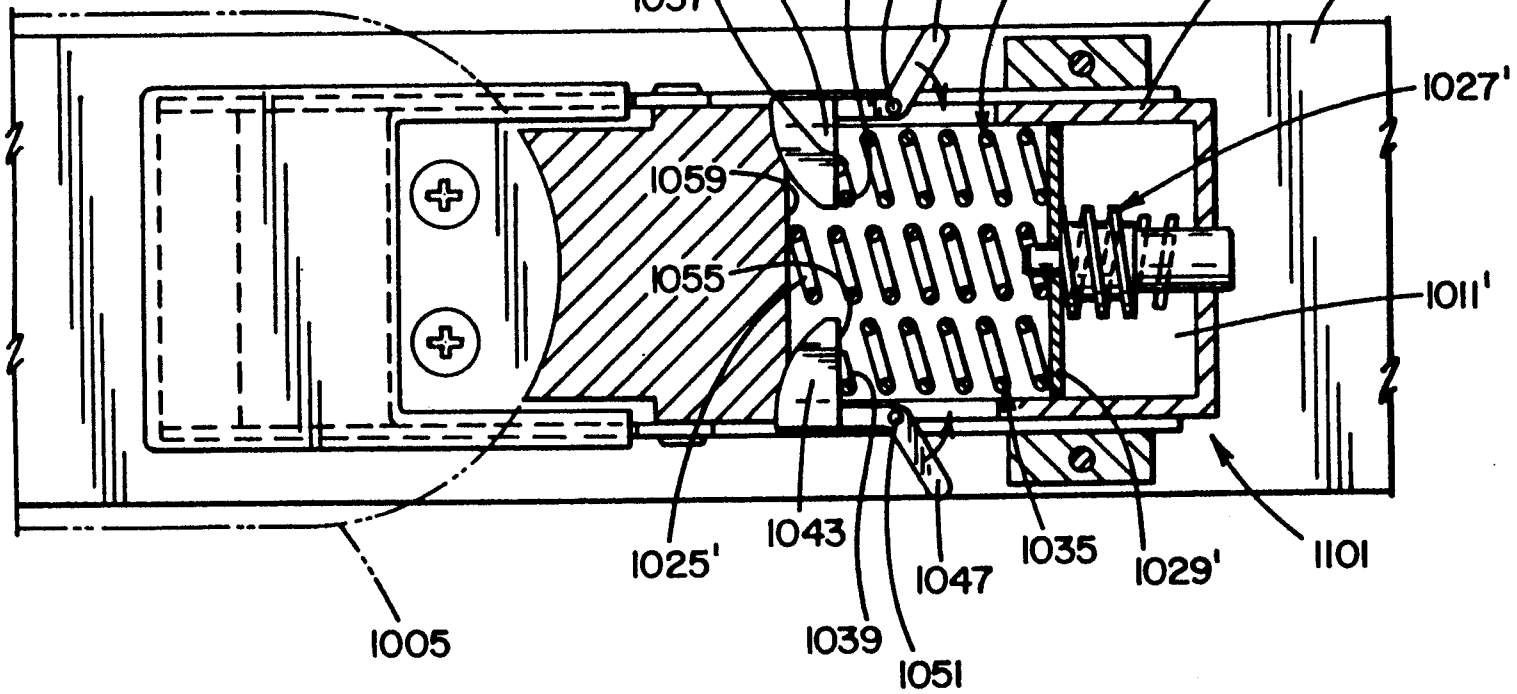
FIG. 30 is a plan view of an embodiment of the invention, showing a ski boot sole with portions removed to indicate important parts of the invention.

Referring now to the cut-away top view of a binding in FIG. 30, a binding 1101 similar to that of FIGS. 27–29 in some respects is shown. (Parts of binding 1101 which are the same as or similar to those in FIGS. 27, 28 and 29 are given the same numerical designation with a prime (')suffix.) Binding 1101 includes a track 1011' fixable to a ski, in which housing 1015', movable in a longitudinal direction, is located. A forward pressure spring 1025' abuts at its rear end to an abutment plate 1029', which is part of screw assembly 1027', and engages housing 1015' at its forward end for urging housing 1015' forwardly when the heel holder is in its down, heel-holding position. This urges the heel holder and boot sole 1005 forwardly against the toe piece.

Spring means, here including longitudinally extending springs 1035 and 1037, are provided for abutment at their rear portions to abutment plate 1029'. Stiffener springs 1035 and 1037 are shown parallel to forward pressure spring 1025', and have forward portions 1039 and 1041. A pair of plugs 1043 and 1045 are shown in front of forward portions 1039 and 1041 of springs 1035 and 1037, for exerting the biasing force of those springs against housing 1015' when binding 1101 is in its boot-holding condition. The biasing force of each of these springs collectively adds to the biasing force of forward pressure spring 1025'. This adds stiffness to the sole and spring combination, and adds stiffness to the ski beneath the combination.

A pair of spring actuating levers 1047 and 1049 are connected to a pair of plugs 1043 and 1045, and are rotatable about axes 1051 and 1053 perpendicular to ski 107, and extend outside of the area in which springs 1025', 1035 and 1037 are located. When plugs 1043 and 1045 are in the paths of springs 1037 and 1039, their faces 1055 and 1057 receive the biasing force of those springs and exert the biasing force on abutment 1059 of housing 1015'. In order to relieve the biasing of spring 1035 on sole 1005 and to decrease the stiffness of the ski, lever 1047 can be rotated counterclockwise as shown by the arrow to move the plug outside of the path of spring 1035, so that the forward end of spring 1035 is now not exerting its biasing force on housing 1015' or on sole 1005. Likewise, lever 1049 can be rotated clockwise to move plug 1045 out of the path of spring 1037 to deactivate that spring and eliminate its biasing force and the stiffness caused thereby. Movement of levers 1047 and 1049 should be done when the boot is not in the binding, since the spring is unloaded and easy to compress or decompress. The sole is configured to enable levers 1047 and 1049 to move their respective plugs. An appropriate stop is included to keep plugs 1043 and 1045 in the stiffening position in the paths of the two springs.

Many variations on means for selectively applying biasing force to the sole to vary the stiffness of the ski are possible. If spring means are used to provide the biasing forces for adding and changing the stiffness of a ski, the spring means can include springs which are stacked horizontally or vertically; they can have different configurations; and they can be of various types such as leaf springs, wire springs and various resilient materials. They can be springs which exert their biasing force when compressed, or can be springs which are stretched to exert their force when the binding is placed in its boot-holding condition, and those springs can be changed or their force altered to change the stiffness of the ski. The biasing force could be hydraulic or electrical in nature for the various embodiments.

One version of the invention involves the exertion of biasing forces on the ends of a ski boot sole to force the sole into a portion of a ski binding, and to vary the biasing forces to vary the stiffness of the ski to bending. Another version is to divide the sole itself into two sections, and to apply biasing forces between the sections to urge them into ski binding portions—generally the heel piece and the toe—and also has the effect of imparting stiffness to the ski as the ski bends. Biasing forces can be urged from the toe or the heel of the boot, and when inserted in a binding the biasing forces can urge the boot against the binding and add stiffness to the ski. In these situations, the heel piece and the toe piece can be fixed on the ski, since any movement of the sole relative to the ski as the ski bends is accomplished by the movement of the portions of the sole or by the entire sole. The biasing means can be varied to vary the stiffness of the ski binding.

Figure 31:
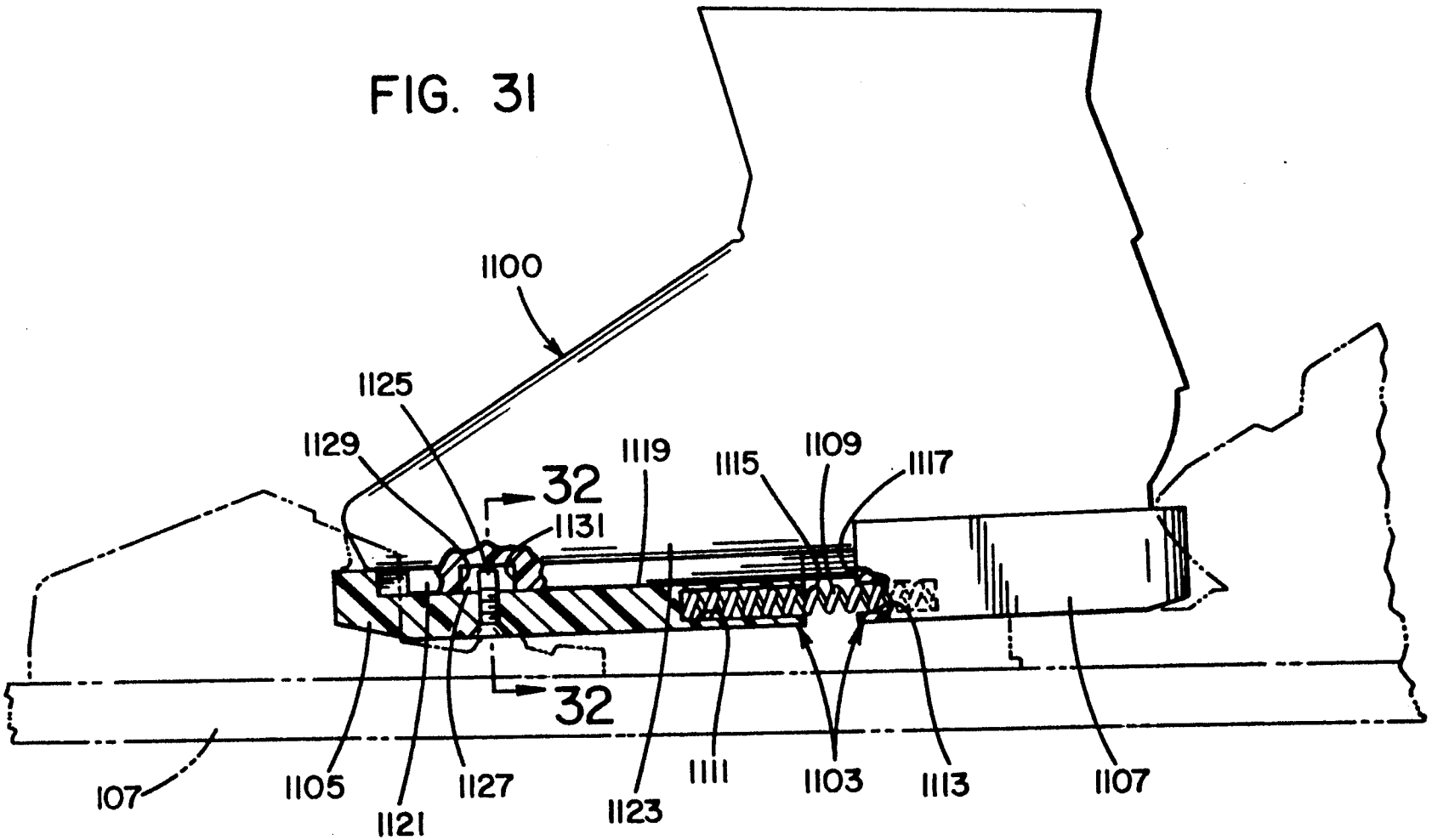
FIG. 31 is another embodiment of the invention showing a sole having more than one portion with another means for operating the invention.

Referring to FIG. 31, a ski boot 1100 includes a ski boot sole 1103, which is divided into two portions—a front portion 1105 and a rear portion 1107. These portions are operatively connected by spring means, which here is a spring 1109. Spring 1109 extends into channels 1111 and 1113, which themselves are aligned and extend longitudinally into sole portions 1105 and 1107 from the opposing edges 1115 and 1117 of the sole. Boot 1100 is shown for mounting in a binding having a toe piece fixed on a ski and a heel piece fixed on a ski. Boot portions 1105 and 1107 are relatively movable on boot 1100, and one possible means for doing this is discussed below. As sole 1103 is received between the binding parts, portions are urged apart from each other by spring 1109, which urges the forward and rearward ends of sole portions 1105 and 1107 against the toe piece and the heel piece. Spring 1109 also contributes to the stiffness of the sole and to the underfoot stiffness of the ski, and changes in the strength of spring 1109 likewise change this stiffness.

Figure 32:
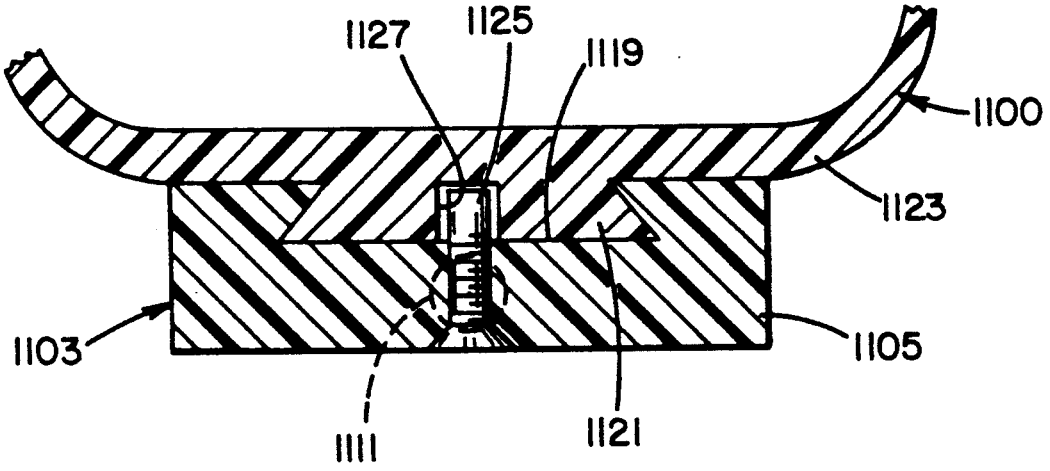
FIG. 32 is a view taken in the direction 32-32 in FIG. 31.

FIGS. 31 and 32 depict one construction of boot sole 1103. In FIG. 32, the upper part of portion 1105 has a dovetail-shaped channel 1119 which is wider at its base than at its top. A flange or rib 1121 extending downwardly from the body 1123 of boot 1100 has a similar dovetail configuration, with its lower portion being wider than at its top, so that sole portion 1105 can slide on the flange. Sole portion 1107 is fixed to the ski boot, and portion 1105 is movable longitudinally. A protrusion 1125 extends upwardly in sole portion 1105 into a cavity 1127 in flange 1121. The cavity must be of such a length, defined by end walls 1129 and 1131, to allow movement of sole portion 1105 on flange 1121. In a preferred form of this embodiment, this length would be about 1 cm.

Figure 33:
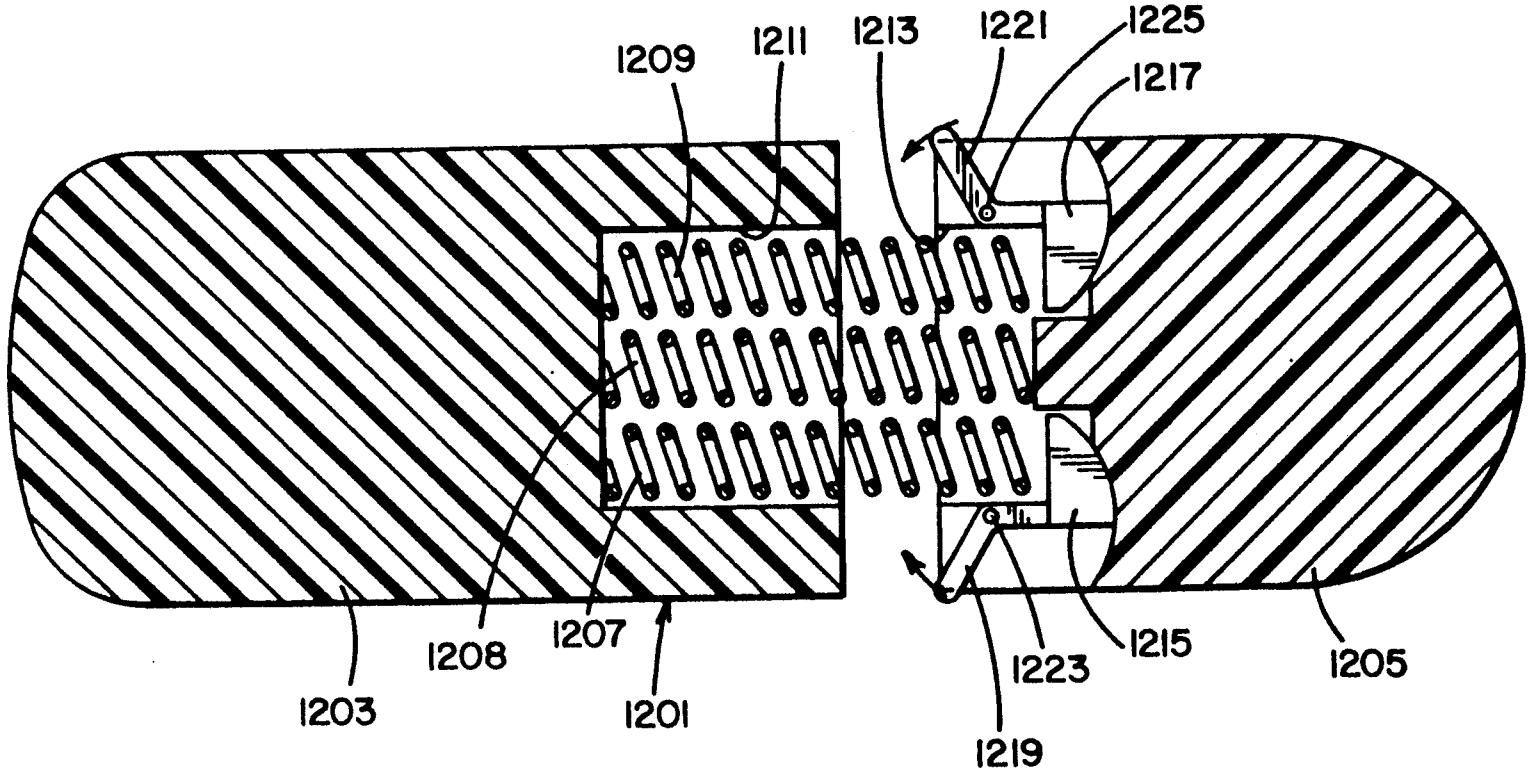
FIGS. 33 and 34 are plan, cut away views of ski boot soles according to other embodiments of the invention.

An embodiment having a boot sole with more than one portion and variable biasing means is shown in FIG. 33. This version is similar to that shown in FIG. 30. The boot body and the means for attaching the movable portion or portions of the sole to the boot body are not shown, and only a top view of the sole is depicted. Here, a boot sole 1201 includes two portions 1203 and 1205 movable relative to each other, with forward portion 1203 being movable on the boot body, portion 1205 being fixed. Spring means, here three springs 1207, 1208 and 1209, extend longitudinally in aligned channels 1211 and 1213 in portions 1203 and 1205. Spring 1208 is a pressure spring for urging the sole portions into the binding portions when the boot is mounted on a ski. Plugs 1215 and 1217, rotatable by levers 1219 and 1221 on axes 1223 and 1225, move the plugs to selectively apply the biasing force of springs 1207 and 1209 to sole portions 1203 and 1205 to vary the stiffness of the sole and of the ski, as described earlier with respect to FIG. 30. Sole portion 1205 is configured to enable the movement of plugs 1215 and 1217. Sole portion 1203 can be movable by any convenient device, such as the flange and channel mechanism of FIGS. 31 and 32. Levers 1219 and 1209 should be operated when the boot is off the ski with springs 1207 and 1211 unloaded.

Figure 34:
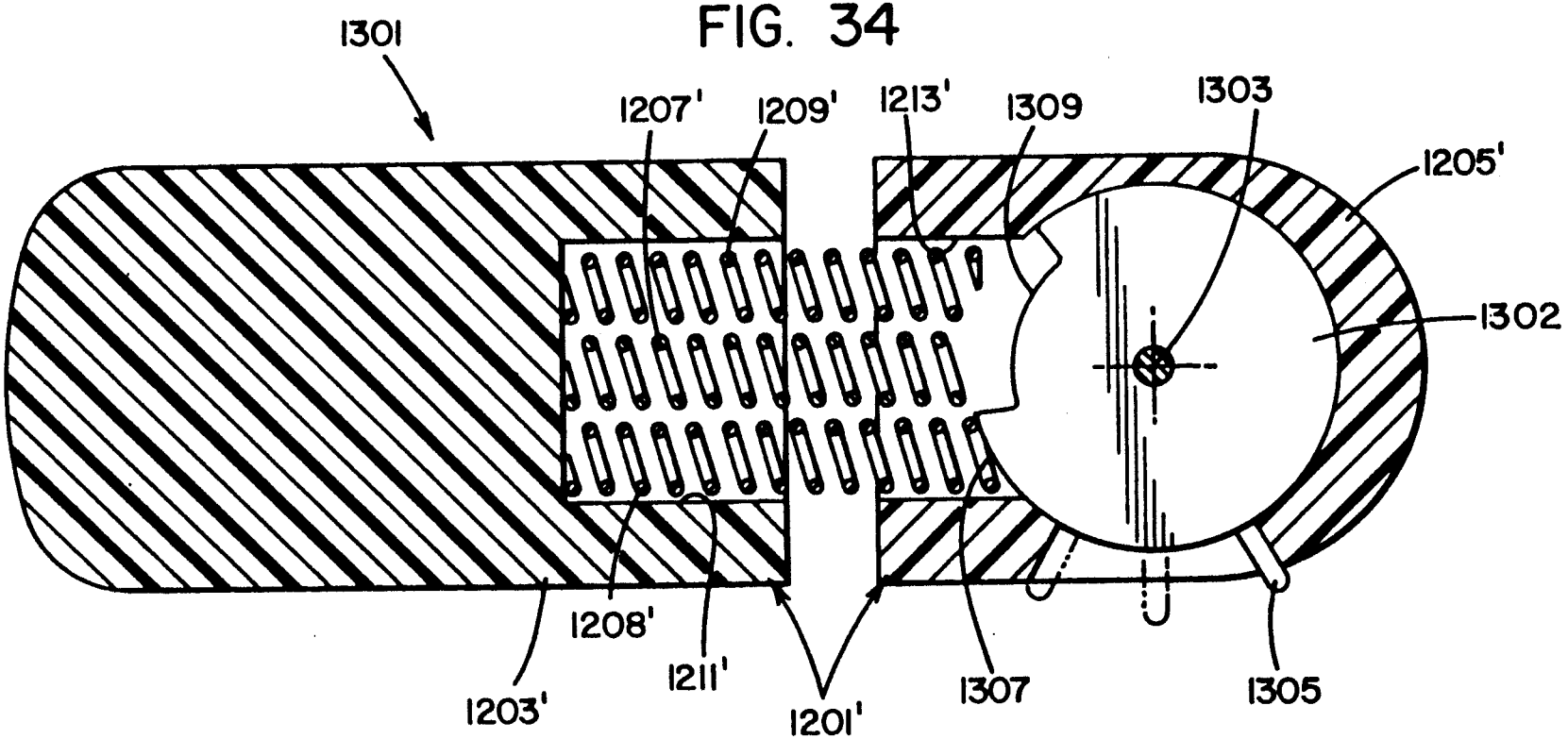

FIG. 34 is another version 1301 of that shown in FIG. 33, and the same general parts have their earlier numerical designations with a prime (') sign. A ski boot sole 1201' has a forward or toe portion 1203' and a rearward or heel portion 1205', and springs 1207', 1208' and 1209', with spring 1208' being the primary forward pressure spring, extending between aligned channels 1211' and 1213' in the sole portions, with the forward ends of the springs abutting against the forward end wall of channel 1211'. A cam disc 1302 is rotatable about an axis 1303 extending vertically with respect to the sole, and a lever 1305 rotates the disc. The disc has an extended peripheral portion 1307 extending part way around the periphery of the disc, and a recessed portion 1309 extending the rest of the way. Those springs in compression by portion 1307 exert biasing forces on the sole portions, and increase the stiffness of the ski, since they resist the bending of the ski in the convex direction. Portion 1307 is always in the path of spring 1208', so that spring 1208' always exerts a forward pressure when the boot is mounted in the binding, since spring 1208' is the forward pressure spring. Those springs opposite recessed portion 1309 do not exert a compressive force on the sole portions and do not add to the stiffness of the ski when the boot is in a binding. When high stiffness of the ski is desired, such as when the ski slope is icy, the skier rotates lever 1305 clockwise when the ski is out of the binding and springs 1208' and 1209' are unloaded, to place extended portion 1307 in the paths of the springs, to compress the springs when the boot is placed in the binding. When less stiffening is desired, lever 1305 is rotated counterclockwise to disengage the disc from the spring, i.e., to place recessed portion 1309 in alignment with springs 1207' and 1209', so that the biasing force is not incurred on the sole portions.

Figure 35:
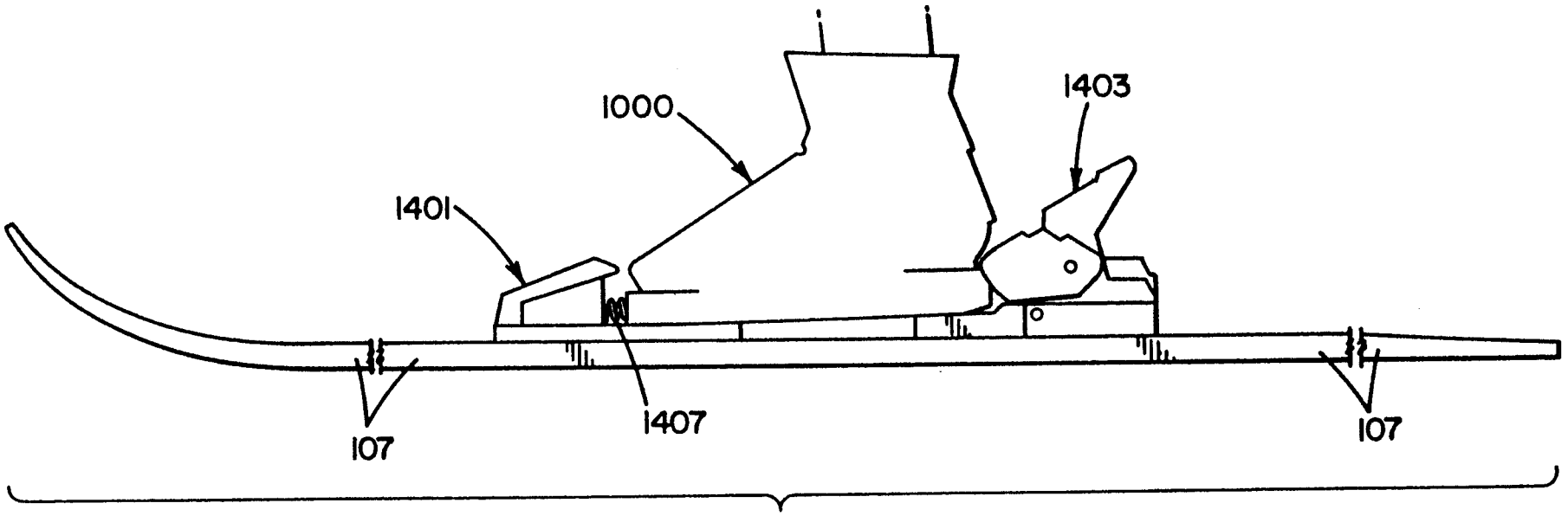
FIG. 35 is a side view of yet another embodiment of the invention, showing spring means at the toe piece of a boot which is mounted on a ski.

In another embodiment of the invention shown in FIG. 35, biasing means can exert biasing forces from the ski boot itself, and to make the system usable with a fixed toe piece 1401 and fixed heel piece 1403 on the ski. Biasing means, here spring 1407, extends from the toe part of the sole of the boot. The ski boot can be inserted with its biasing means 1407 engaging the toe piece to attach the boot to the ski. Means must be provided for holding the sole spring or biasing means in the toe piece. The biasing means exert stiffness to the ski to resist the bending of the ski and could be changed to change that stiffness.

Figure 36:
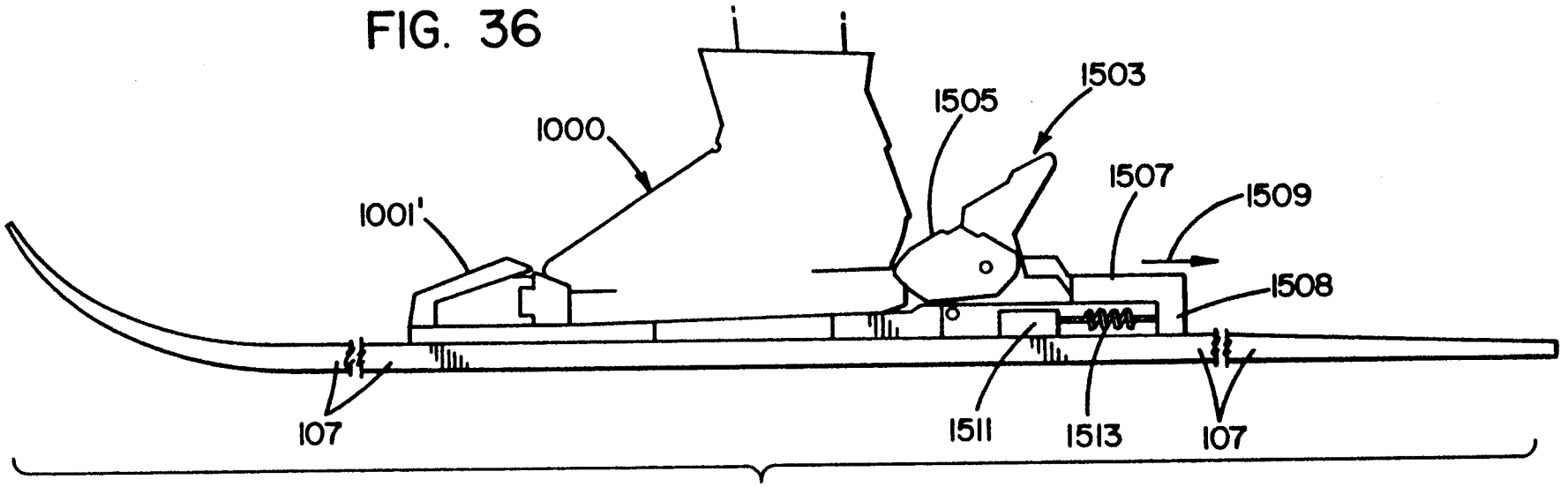
FIG. 36 is another schematic view of another embodiment of the invention, shown in side, partially cutaway form.

Another version of the invention is shown in FIG. 36, where a binding comprises toe piece 1001' and heel piece 1503 attached to ski 107. Heel piece 1503 includes a heel holder 1505 for engaging the sole at the heel of boot 1000, and a housing 1507 which is slidable in an appropriate track as the ski bends in the direction of arrow 1509. An attachment member 1511 is fixed to the ski, and has a set of springs 1513 attached at their forward ends to the rearward end of member 1511. The other ends of springs 1513 are attachable to housing 1507. Springs 1513 attached to housing 1507 are stretched when a boot 1000 is loaded in the binding. Springs 1513 contribute to the stiffness of the binding and to the underfoot part of the ski. Changing which of the springs exert biasing forces on the boot will change the stiffness of the ski; and means for changing the biasing force can include means for selectively hooking the rear ends of the respective springs 1513 to the downward leg 1508 of housing 1507, to stretch only those springs hooked thereto, to vary the stiffness of the ski.

The movement of the biasing means described in FIGS. 30–38 to add stiffness to the ski is normally a small amount. In the embodiments shown it can be only a few millimeters to obtaining the stiffening action desired.

Figure 37:
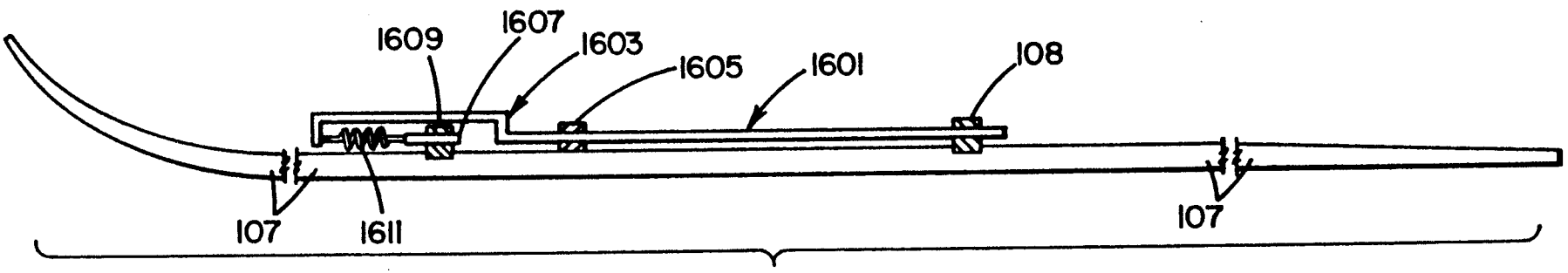
FIG. 37 is a schematic view of another embodiment of the invention.

The use of stretching spring means would also apply if a moving bar were used to control stiffness. Referring to FIG. 37, a plate 1601 is mounted on a ski 107, with one end fixed to the ski 107 by a fastening member 108. Plate 1601 has a free end 1603 which is slidable in clamp 1605. A stop 1607 can be moved forward or rearward in clamp 1609 to control stiffness. Plate 1601 is connected by biasing means such as a spring 1611, to stop 1607. As ski 107 bends, plate 1603 stretches spring 1611. As the bending increases, the spring force gets progressively greater, to resist the sliding of bar 1603 and to increase the stiffness of the ski.

Figure 38:
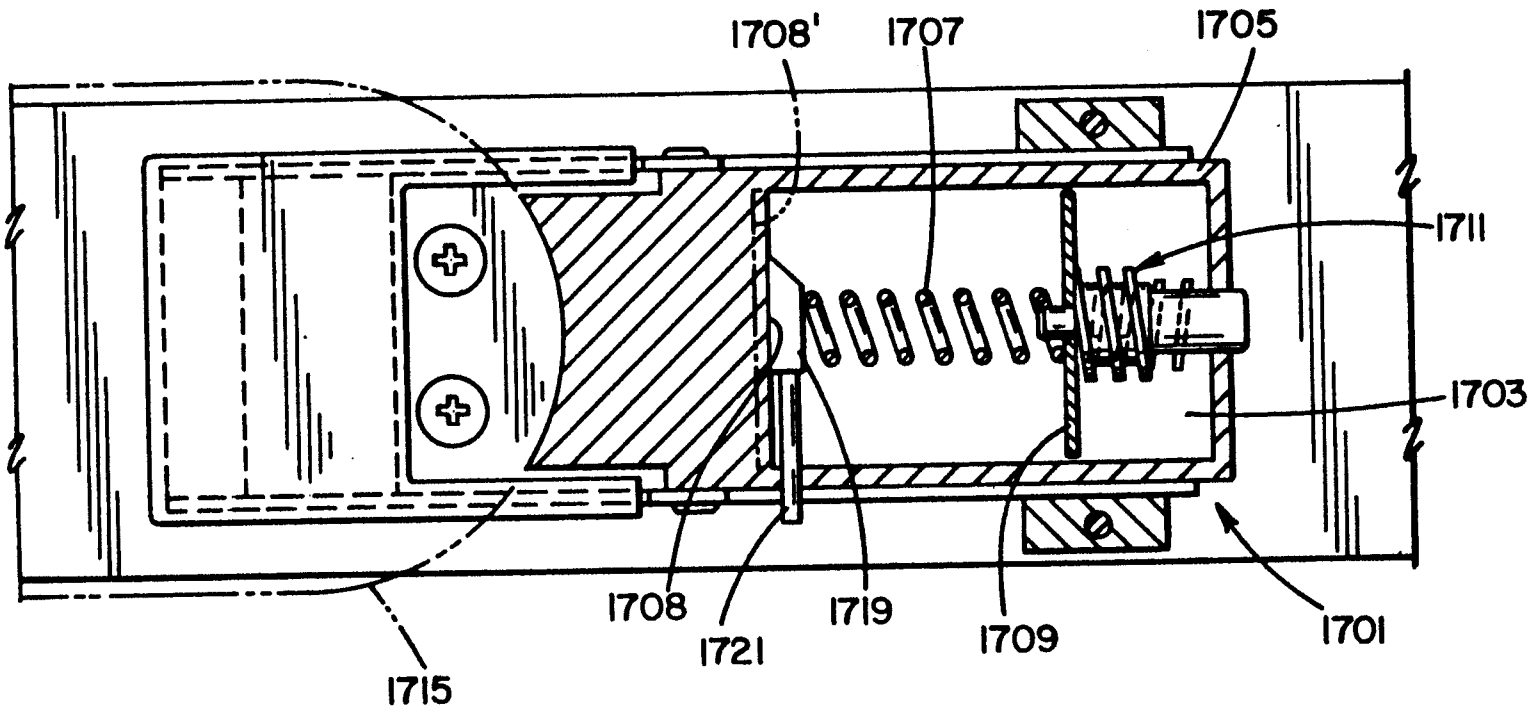
FIG. 38 is a schematic view of another embodiment of the invention.

A single biasing member can be used to serve as both the forward pressure device and as a stiffening device. Referring to FIG. 38, a heel piece 1701 is shown. Heel piece 1701 has a track 1703 fixed to the ski, and a housing 1705 is slidable in the track. A forward pressure spring 1707 abuts the forward side of an abutment plate 1709, which is part of screw assembly 1711. Spring 1707 extends forwardly from abutment plate 1709. Before boot 1715 is mounted, the rear face 1708' of housing 1705 is in its dotted-line position, resting close to spring 1707. When boot 1715 is inserted in the heel holder of housing 1705, rear face 1708 compresses spring 1707 a relatively small amount. A stiffening plug 1719 can be inserted transversely along the rear face 1708 of housing 1705 with its handle 1721 when the heel piece is unloaded, and this moves housing 1705 forwardly (with the rear face moved to its solid-line position 1708) by the longitudinal thickness of plug 1719. Plug 1719 is releasably locked in place by a detent arrangement 1722. Now when boot 1715 is inserted in housing 1705, it compresses the spring by the thickness of plug 1719 and by the distance it itself applies. The spring now further stiffens the ski.

The use of a readily operable plug or bias changing means makes this embodiment usable on the slope. Tightening screw assembly 1711 could increase the stiffness of the spring, but this would be so difficult as to make the use of the screw assembly impractical. Also, a single biasing means as described above can be used on a ski boot sole, which can be in several portions.

Various systems for controlling the stiffness of a ski have been described above. The skier may manually, or perhaps with the ski pole or some other device, adjust the apparatus according to the type of stiffness to be desired. The skier need not have different skiing apparatus for different types of snow or different abilities of the skier, and need not settle for a binding which is appropriate for only one type of skiing or which approximate different types of skiing but cannot adequately control the stiffness precisely for different types of skiing. Now, the skier need only adjust the apparatus for the type of stiffness desired and to participate in the skiing event. The settings can be changed as the skier desires. Furthermore, in some embodiments the skier can continuously adjust the stiffness of the ski. Although many embodiments are given, it should be appreciated that other variations will fall within the scope of the invention.

The invention has been described in sufficient detail to enable one skilled in the art to practice the invention, but variations and modifications within the spirit and scope of the invention may occur to those skilled in the art to which the invention pertains.

I claim:

1. A system for changing the stiffness of a ski, said system comprising:

a toepiece and a heelpiece, one of said toepiece and said heelpiece being fixable to the ski, and the other of said toepiece and said heelpiece comprising:

track means fixable to the ski;

housing means having ski boot holding means, said housing means being movable in said track means by a ski boot held in said holding means towards the one of said toepiece and said heelpiece fixable to the ski, as the ski bends;

abutment means locked relative to said track means during operation of said system;

a pressure spring having one end in engagement with said abutment means and an opposite end in engagement with said housing means for urging said housing means toward the one of said toepiece and said heelpiece fixed to the ski;

at least one stiffening spring means having one end engageable with said abutment means and an opposite end engageable with said housing means for exerting a biasing force on said housing means; and control means comprising spring engagement means movable between an active position for operatively engaging said stiffening spring means with said abutment means and said housing means to increase the stiffness of the ski when the boot is mounted on the ski, and an inactive position for operatively disengaging said stiffening spring means from said abutment means and said housing means to decrease the stiffness of the ski.

2. The invention according to claim 1 wherein said toepiece is fixable to the ski and said heelpiece comprising a heel housing movable in said track means as the ski bends.

3. The invention according to claim 2 wherein said track means comprises a track for holding said heel housing in a sliding relationship, said holding means comprises a heel holder mounted on said heel housing for holding a ski boot, and said abutment means comprises an abutment plate in said heel housing.

4. The invention according to claim 3 wherein said abutment plate is movable on said track for enabling said system to hold different sizes of ski boots, said heel housing comprises adjustment means for locking said abutment plate in a selected position on said track, and said one end of said forward pressure spring comprises a rearward end in engagement with said abutment plate and the opposite end comprises a forward end, and said control means is mounted on said housing for selective insertion between the forward end of said stiffening spring and said housing for providing operative engagement of said stiffening spring and said housing.

5. The invention according to claim 1 wherein said at least one stiffening spring comprises at least two stiffening springs, and said control means selectively changes the number of stiffening springs exerting a biasing force on said housing means.

6. A system according to claim 1 wherein said control means comprises disc means rotatable about an axis transverse to the ski, said disc means having a periphery selectively engageable with at least one of said spring means for exerting the biasing force on the boot to increase the stiffness of the ski as the ski bends.

* * * * *